US005360279A

United States Patent [19]

Asai et al.

[11] Patent Number: 5,360,279

[45] Date of Patent: Nov. 1, 1994

[54] PRINTER INK RIBBON CONTROL

[75] Inventors: Naoki Asai; Choji Morozumi; Yoshikazu Ito; Kiyoshi Ito; Akira Koyabu, all of Suwa, Japan

[73] Assignee: Seiko Epson Corporation, Tokyo, Japan

[21] Appl. No.: 996,453

[22] Filed: Dec. 23, 1992

[30] Foreign Application Priority Data

Dec. 25, 1991 [JP] Japan ..... 3-343448
Dec. 2, 1992 [JP] Japan ..... 4-323379

[51] Int. Cl.[5] ..... B41J 35/14

[52] U.S. Cl. ..... 400/216.1; 400/215; 400/216

[58] Field of Search ..... 400/216.1, 216, 211, 400/216.2, 216.5

[56] References Cited

U.S. PATENT DOCUMENTS

| | | | |
|---|---|---|---|
| 4,280,767 | 7/1981 | Heath | 400/216.2 |
| 4,368,993 | 1/1983 | Brass et al. | 400/216.2 |
| 4,854,027 | 8/1989 | Smith et al. | 29/434 |
| 4,867,587 | 9/1989 | Kishida et al. | 400/216.2 |
| 5,080,511 | 1/1992 | Iwata | 400/216.1 |
| 5,112,150 | 5/1992 | Iwata | 400/216.1 |
| 5,154,520 | 10/1992 | Muto et al. | 400/216.1 |

FOREIGN PATENT DOCUMENTS

| | | | |
|---|---|---|---|
| 0158963 | 10/1985 | European Pat. Off. . | |
| 0160832 | 11/1985 | European Pat. Off. . | |
| 4616 | 1/1978 | Japan . | |
| 34991 | 3/1980 | Japan . | |
| 36185 | 8/1985 | Japan . | |
| 0044488 | 2/1987 | Japan | 400/216.1 |
| 41356 | 6/1991 | Japan . | |
| 213383 | 9/1991 | Japan . | |
| 239683 | 8/1992 | Japan . | |
| 2029327 | 3/1980 | United Kingdom | 400/216.1 |

*Primary Examiner*—Edgar S. Burr
*Assistant Examiner*—John S. Hilten
*Attorney, Agent, or Firm*—Eric B. Janofsky

[57] ABSTRACT

A compact, lightweight printer capable of using multi-track ink ribbons that facilitates multicolor printing, without having a dedicated track switching drive system. The printer employs a printing track setting member that is activated by contact pressure from a print head carriage when it moves in one direction and vertically displaces a ribbon frame supporting the ribbon to one of several preselected heights with respect to the print head. The setting member is preferably made in the form of a setting lever with a drive end for interacting with the print head carriage and a setting end with a series of setting height stops that interact with the ribbon frame. Rotation of the setting lever places different setting level stops under the frame which varies its height accordingly. A printing track release member is also provided which is activated by contact pressure from the print head carriage when it moves in an opposite direction and raises the ribbon frame to disengage the track setting member and move the ribbon support frame to a new height. The track release member is preferably formed as a rotatable release shaft with drive end for interacting with the print head carriage and a release end with a lever extending under and toward the ribbon cassette. Rotation of the track release member shaft causes the lever to raise the ribbon frame accordingly.

17 Claims, 15 Drawing Sheets

PRINTER INK RIBBON CONTROL

BACKGROUND OF THE INVENTION

1. Field Of the Invention

The invention relates generally to printers using ink ribbons having multiple widthwise printing tracks and more particularly to a switching mechanism for selecting a desired track on the ink ribbon. The invention further relates to a printing mechanism for achieving a compact color printer using multi-track multi-color print ribbons.

2. Description of Related Technical Art

The color printing process or color printers commonly employ ink ribbons having multiple ink tracks each with a different color. A printer is shown in FIG. 10 which is capable of printing in color using an ink ribbon 90 which has three widthwise color tracks, 91, 92, and 93 which are black, red, and blue, respectively. Switching between the three tracks 91, 92, 93, is typically performed using driver such as a motor 21. The illustrated printer is a dot matrix type of printer in which a print head 81, which has a series of electrically actuated print pins, is mounted on a carriage 83 that reciprocates laterally along a main guide shaft 82 to form a series of image forming dots during printing. An example of track switching technology using a multicolor ink ribbon is disclosed in more detail in Japanese Laid-Open Patent Publication 3-41356, and is outlined further below.

Carriage 83 is moved back and forth along main guide shaft 82 by a carriage drive motor 85 typically using a timing belt 84. As head 81 is moved, printing along a path or line in the direction of travel is performed on recording paper 87 or other medium as desired, which is positioned on a platen 86. Three-color ink ribbon 90 is typically housed in a ribbon cassette 95, which rests on an appropriately shaped ribbon frame 96, here box-shaped. Ribbon frame 96 is moved or displaced up and down by a switching arm 23, which moves along a guide 22 fixed to a printer base 88, and as a result ribbon tracks 91, 92, and 93 are also moved up and down in front of print head 81, and selected for use. Switching arm 23 is pivoted up and down by a cam wheel 25 which is in turn driven or rotated by switching motor 21 using a gear 24, and the position of selected tracks 91, 92, and 93 can be confirmed using a position sensor 26 disposed on the cam wheel.

An alternative printer structure is shown in FIG. 11 in which an ink ribbon 90 is used having only two widthwise color tracks 91, which is black, and 92, which is red in this example, and print head 81 is driven along guide shaft 82 by a drive arm 30, which is rotated by carriage drive motor 85. Again, ribbon 90 is housed in a ribbon cassette 95 mounted on ribbon frame 96. Two solenoids, 31 and 32, are used to set or select either color track 91 or 92 in this printer structure as desired. First solenoid 31 is used to select upper track 91 of ribbon 90, by moving a setting rod 33. As a result of the rod 33 motion, ribbon frame 96 is pulled downward using a setting arm 34 which protrudes from ribbon frame 96.

When ribbon frame 96 moves downward, a spring 36 causes a setting hook 35 to be biased against and interlock with ribbon frame 96, which is then set or temporarily locked in this lower position. In this configuration, track 91 is selected and the color black is used by print head 81 during printing operations. When solenoid 32 pulls against setting hook 35 so as to resist the force of spring 36, setting hook 35 disengages its contact with ribbon frame 96 which is released to travel upward under the biasing action of a spring. This latter action results in track 92 being selected and the color red being used by print head 81 during subsequent printing operations.

Therefore, using the above configurations and general operating procedures, printing with a plurality of colors is facilitated using an ink ribbon on which a series of widthwise color tracks are formed.

Currently many printers are becoming increasingly compact with an eye to achieving portable use, while trying to maintain a multicolor printing capability. Such compact or portable printers must be particularly light in weight and have decreased power consumption, while also having low production costs. However, continuing to perform ribbon color track selection, as described above, using a motor, solenoid or other dedicated driver device, increases both the weight and power consumption of the printer. Aside from these drawbacks when using a heavy, power-consuming, drive system motor or solenoid, overall printer reliability is also decreased while production costs are increased due to an increased number of parts such as levers, hooks, and gears, employed in implementing such drivers.

At the same time, there is a demand for three or more colors instead of just two, which requires more complicated drive and control systems to be added to effect ink ribbon track selection the various tracks, thus, further aggravating the above problems.

What is needed is a technique for selecting different ink ribbon color tracks which does not employ specialized, heavy or excessively power consuming, track selection drivers. It is also desirable that any track selection system provide for efficient switching among three or more tracks with minimum complexity and few parts.

SUMMARY OF THE INVENTION

In order to solve the above and other problems encountered in the art, the present invention provides a print head motion actuated ribbon shift mechanism capable of selecting tracks on an ink ribbon for printing in response to movement of the print head.

One purpose of the invention is to realize a multicolor printer that does not employ a separate power consuming ribbon track switching or selection mechanism.

An advantage of the invention is that it provides a lightweight and low-power consumption solution for manufacturing multi-color printers.

Another advantage of the invention is low complexity and related costs for manufacturing ribbon selection elements.

Another purpose of the invention is to provide a mechanism for easily switching ribbon color tracks on ribbons with three or more such tracks.

These and other purposes, objects and advantages, are realized in a printer for use with an ink ribbon having two or more printing tracks, which has a print head that moves along a predetermined path adjacent to a recording medium and uses the ink ribbon to form images thereon, and an associated line driver for reciprocating the print head between first and second ends of the path. The ribbon is mounted in the printer so that it is positioned between the print head and the print medium, typically enclosed within a removable print ribbon cassette. The printer employs color track ribbon selection, setting, or shift apparatus that sets the ink ribbon at one of a plurality of heights relative to the print head in order to select a desired ribbon track for printing. A track release mechanism is employed for resetting the height of the ribbon when color changes are desired. The ribbon selection apparatus is configured to alter the print ribbon height, or set the ribbon at one desired track height from among several preselected track heights, in response to movement of the print head, or its support structure, to positions adjacent to the first end of the print head path. The track release mechanism is configured to release ribbon height settings in response to movement of the print head to a position adjacent to the second end of the print head path.

The ribbon shift apparatus uses a track setting element, with a setting drive end portion that engages and is moved by the print head, and a shift end portion that engages the ribbon. Since the ribbon typically rests on a support frame, the ribbon shift end portion is configured to engage and alter the vertical position of the ribbon support frame to alter the relative height of the ribbon. Ribbon height is selected in accordance with the amount of head movement within a first end non-printing zone after it contacts the drive end portion. A shift end setting stop element is used to engage the shift end portion, and constrain further movement to temporarily set the ribbon at a selected height.

A preferred embodiment of the ribbon shift or track setting apparatus is a bar shaped track setting lever that is positioned adjacent to and just below a ribbon frame supporting the ribbon, or a ribbon cassette housing the ribbon. The track setting lever has a drive end with a flat edge or an extension for interacting with a protrusion on the print head support structure and an opposite wedge-shaped shift end which has a series of ascending steps or height stops formed on a surface facing the ribbon support frame. The shift end stops interact with and vertically displace the ribbon support frame to change the height of the ribbon frame relative to the position of the print head. The wedge-shaped shift end pivots in concert with displacement of the setting drive end by the print head while the ribbon frame engages the shift end of the track setting lever, typically from above. During at least part of its rotation, an upper portion of the wedge-shaped shift end is inserted into a stop aperture or slot which provides clearance for unused stops on the shift end while a selected stop engages the ribbon support frame, and helps restrain movement of the track setting lever after a setting is reached. Therefore, the amount by which the wedge-shaped shift end is inserted into the stop aperture is determined by the amount of print head movement, which in turn determines the change in ribbon frame height.

The track release mechanism uses a shift end release member mounted adjacent to the ribbon, or ribbon support frame, having a release drive end portion that engages and is moved by the print head, when the print head moves into a second non-printing zone near the second path end and a shift end release portion that engages the ribbon or a ribbon frame and pushes upward to release engagement between the track setting lever and the ribbon frame.

A preferred embodiment of the shift end release member is a generally cylindrical element that rotates freely about an axis parallel to the plane of the ribbon support frame and has a drive end with an extension for interacting with a protrusion on the print head support structure and an opposite release end with a lever-shaped configuration. Print head contact with the release member drive end causes it to rotate which in turn rotates the shift end release lever which pushes upward on the ribbon frame. Upward vertical movement of the print ribbon support frame releases engagement between the ribbon support frame and the wedge-shaped shift end of the track setting lever. Accordingly, the track setting mechanism is released and returned to a prescribed position by a force exerted by an elastic member. As the print head moves to disengage the drive end of the release lever, the previously raised ribbon frame is returned to its prescribed position by either its own weight or the elastic force of an elastic member, such as a spring.

A color determination device is used to interpret commands and data provided to the printer to ascertain what color is desired for printing. A comparator is used to compare any new color value designation with the current color selection to determine if a change in color is being specified, otherwise, no ribbon shifting is performed. Alternatively, corresponding track values are compared to determine if a new color is being selected. When a new color is selected, the new color is stored as a color value in a color memory for later comparison with subsequent color designations along with a ribbon track number corresponding to that color on the multicolor ribbon. At the same time, track numbers or positions corresponding to the new and current colors are also compared to determine the amount and direction of shifting required to reach the new track from the old track.

A print head motion controller uses information from the track comparison to command the line driver to move the print head into either the first or second non-printing zones and activate operation of either the track release, second zone, or track setting, first zone, mechanisms. That is, an old color setting is released by head movement in the second non-printing zone, and a new color is set when the track setting lever is displaced sufficiently by head movement in the first non-printing zone so as to position the appropriate setting stop under the ribbon support frame and temporarily set a new vertical height for the ribbon. When the track release lever, with its vertically displaced setting stops, is elastically biased to automatically withdraw from engagement with the ribbon support frame when the frame is lifted, a track release operation can be performed to select a new track number larger than the current track number, and a track setting operation can be performed to select a new track number smaller than the old track number. The head controller also determines the amount of print head movement within each selected non-printing zone sufficient to effect a desired change. After a new color is selected the head continues to reciprocate along the print head path and provide output on the print medium.

In further aspects of the invention, where sloped or slanted transitions are used between setting stops on the shift end of the track setting member, it is not always necessary to release the ribbon setting before proceeding to an adjacent higher or lower vertical displacement, depending on the slant. However, when using the force of a retraction spring to withdraw the setting lever, release is generally needed to make transitions to other vertical settings. Alternatively, the shift end of the track setting member can also be configured to interact with the top or a side extension of the ribbon frame, and have steps on an underside of the lever which extend downward.

In another aspect of the invention, a reference position detector is used to determine a reference position for the print head in order to initialize the position of the print head generally after at least performing a track release operation.

A printer operating according to the principles of the invention, is generally provided with an interface that receives data and commands from a computer or other external device for purposes of directing printing operations. Commands are interpreted to determine if a color is being designated for use in printing. Ira color is being selected its value is stored along with a ribbon track value associated with that color for later use, and the track positions for the newly designated and currently in use colors are compared to determine an appropriate print head movement direction and amount. That is, a comparison of track positions or numbers is performed to determine if the new track has the same, larger or smaller number or vertical position as compared to the current track. When the track number corresponding to the old or current color is determined to be the same as the track number corresponding to the desired new color, no release or track setting operations are performed.

However, when the new track number is larger or smaller than the old track number, the print head is moved to either the first or second non-printing zones based on the change in relative ribbon track value and by an amount which is approximately only that needed within each non-printing zone to effect the change. Track setting is accomplished by moving the print head into the first non-printing zone by an amount needed to operate the track setting mechanism and depending on the amount of movement, one of the tracks on the ink ribbon is selected. Track release is accomplished by moving the print head into the second non-printing zone by an mount needed to operate the track release mechanism.

When the track setting mechanism employs an element for automatically decreasing ribbon height during track release, and the new track number is determined to be larger than the old track number, the new track is simply selected by executing a track release operation. At the same time, if the new track number is determined to be smaller than the old track number, the track is selected by executing a track setting operation.

In another aspect of the invention, the print head is initialized to a reference position generally after at least performing a track release operation. Following print head position initialization, the position of the print head is confirmed and when abnormal conditions, such as interrupted head movement, are encountered, head movement is re-executed. Abnormal condition management processing is also performed when at least one track release operation and an error in the print head position have each occurred subsequent to print head position confirmation.

After releasing a track, print head position initialization is performed regardless of whether there has been any error in the position of the print head. This corrects for any position error that occurs during the track release operation. Alternatively, after releasing a track, the position of the print head is confirmed and if there is any position error, the track release operation is repeated following print head position initialization. In this manner, track releases can be executed more reliably and any error in the print head position can be easily compensated.

Other objects and attainments together with a fuller understanding of the invention will become apparent and appreciated by referring to the following description and claims taken in conjunction with the accompanying drawings.

DESCRIPTION OF THE PREFERRED EMBODIMENTS

The present invention provides an ink ribbon color track selection mechanism and related control method that allows efficient selection of color ribbon tracks for use by a print head as it moves along a predetermined path across a recording medium. The print head is reciprocated by an associated line driver between first and second ends of the path and print head motion in non-printing zones adjacent to the ends of the print head path is used to activate or operate a mechanism that selects different ribbon tracks. The track selection is accomplished by setting the ink ribbon at one of a plurality of heights relative to the print head. A track release mechanism is employed to release ribbon height settings to allow resetting of the ribbon height when color changes are desired.

Figure 1:
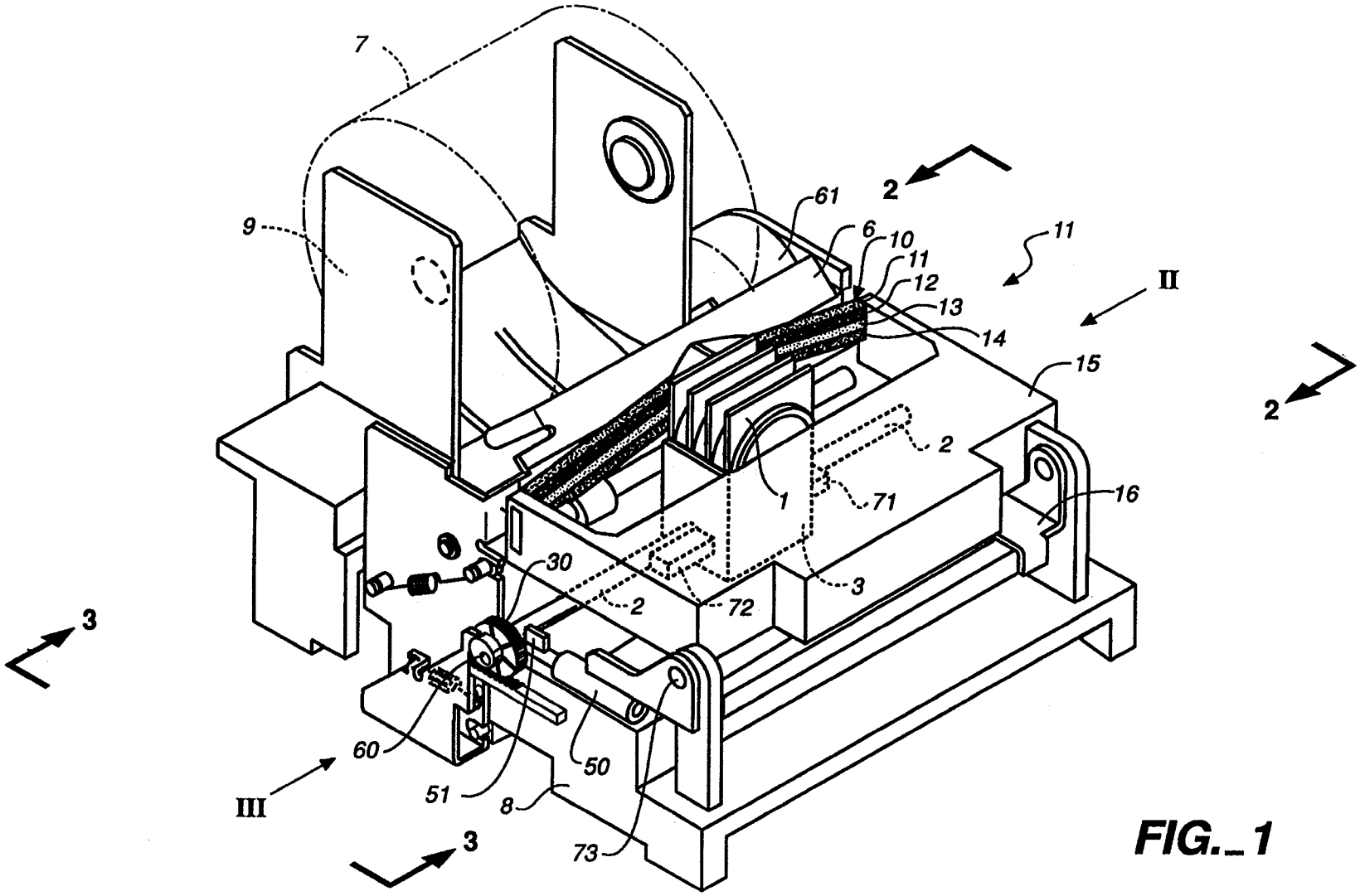
FIG. 1 illustrates a perspective view of a printer constructed and operating according to the principles of the present invention.
Figure 2:
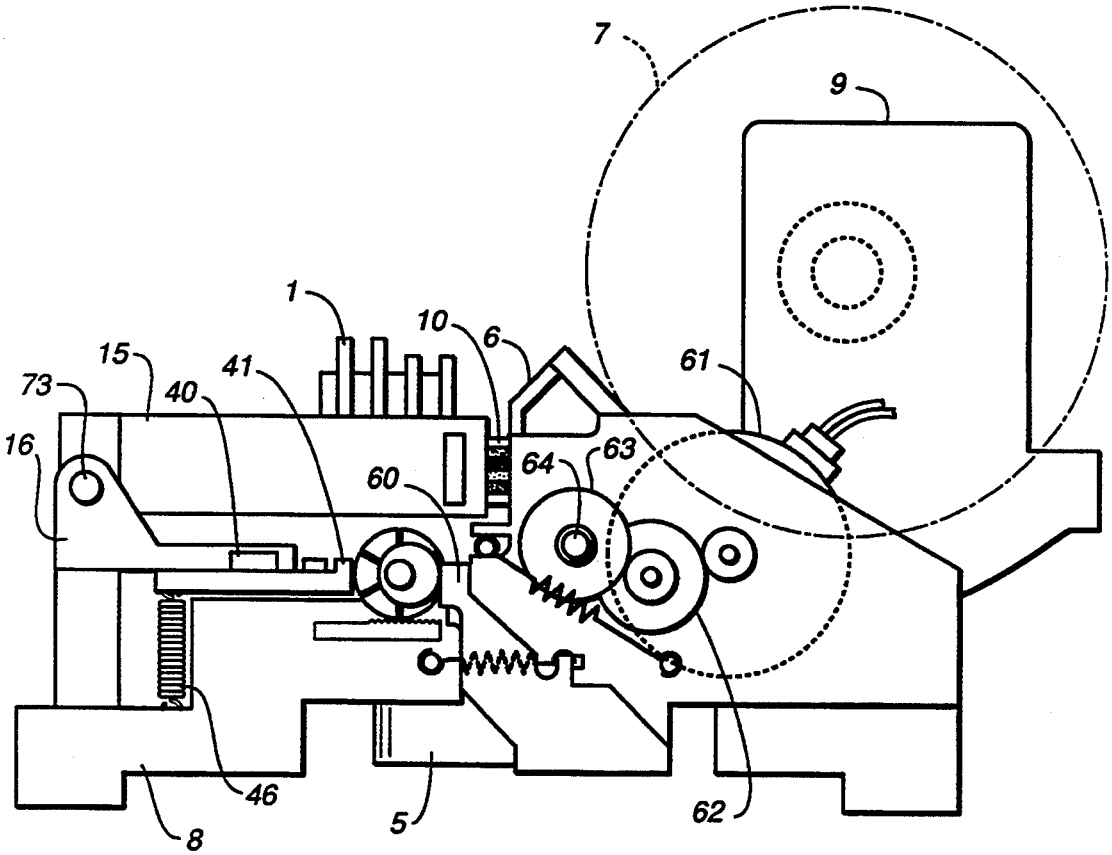
FIG. 2 illustrates a side plan view of a side II of the printer of FIG. 1.
Figure 3:
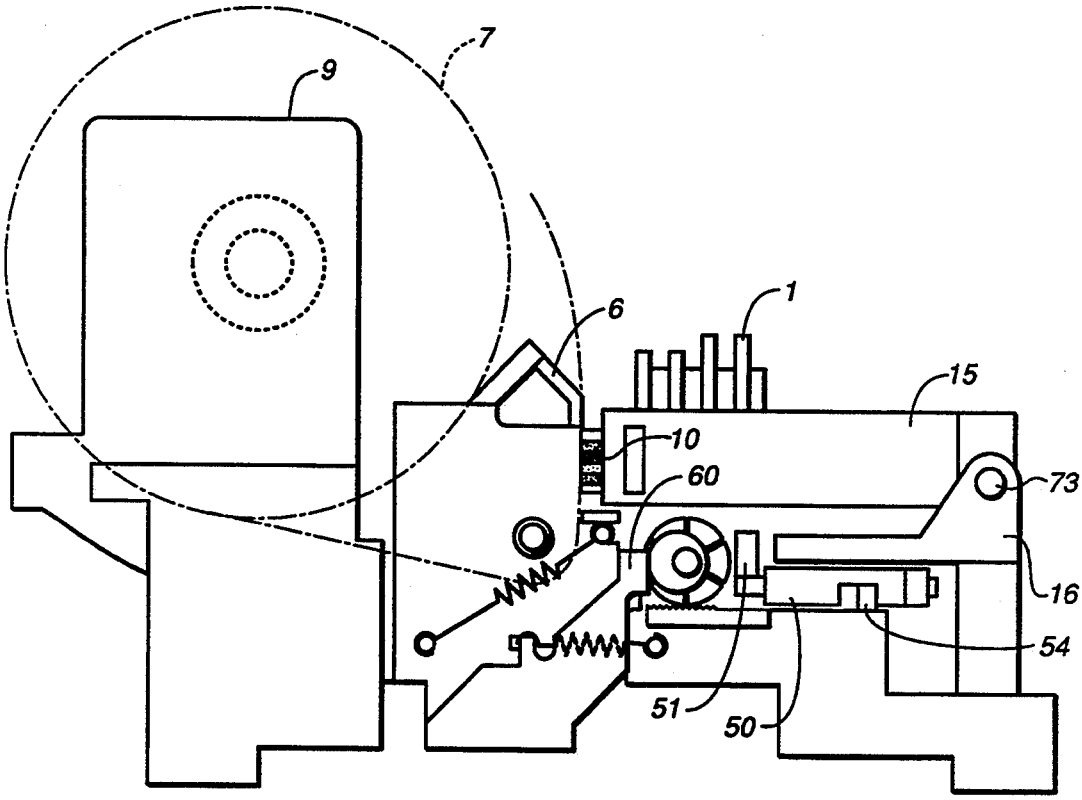
FIG. 3 illustrates a side plan view of a side III of the printer of FIG. 1.
Figure 4:
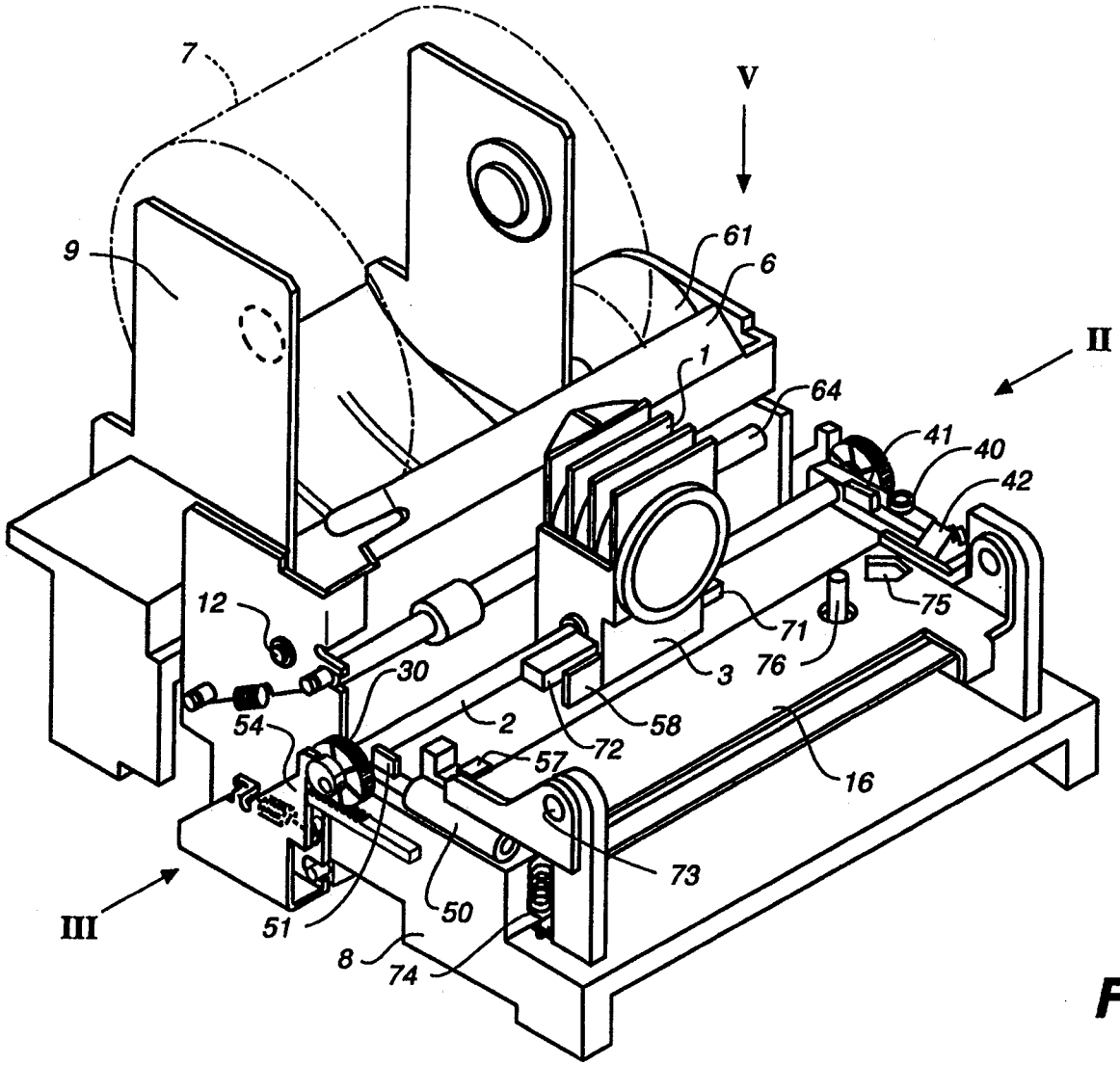
FIG. 4 illustrates a perspective of the printer of FIG. 1 with the ribbon cassette removed.
Figure 5:
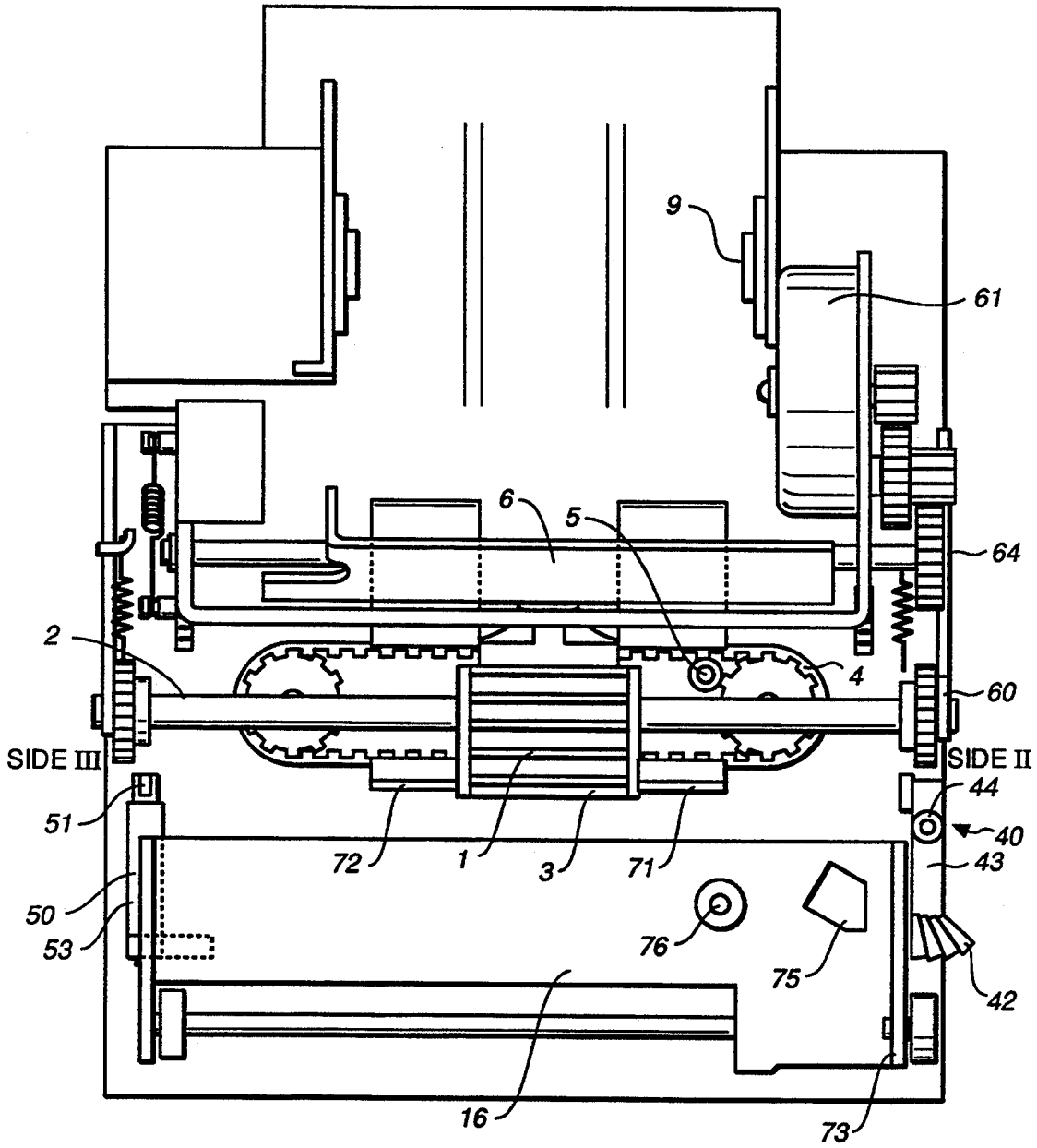
FIG. 5 illustrates a top plan view of the printer of FIG. 4.

Generalized diagrams of a printer constructed and operating according to a first embodiment of the invention are shown in FIGS. 1 through 3 while FIGS. 4 and 5 illustrate the same printer with its ribbon cassette removed. In this embodiment, a platen 6, ribbon frame 16, and other associated components, are mounted or disposed on a plastic printer base, and the printer provides output on a roll of recording paper 7 which is mounted on a paper roll holder 9.

A printer head 1 is mounted on a carriage 3, which moves back and forth laterally along a main guide shaft 2. Carriage 3 is connected to a timing belt 4 which is in turn connected to and driven by a carriage drive motor 5. Motor 5 moves carriage 3 along main guide shaft 2 so that it traverses a line across the face of recording paper or other medium 7 during printing. In this embodiment, carriage 3, carriage drive motor 5, timing belt 4, and main guide shaft 2 constitute a printer line driver mechanism.

A gap fixing mechanism 60, which uses plastic printer base 8, is also employed to maintain a constant specified or predetermined platen gap between platen 6 and print head 1 by compensating for thermal expansion, or similar structural changes. Feed motor 61, which advances recording paper 7 past platen 6, is disposed on one side of the printer, here labeled II, and turns a feed shaft 64 typically using one or more gears 62 and 63. An ink ribbon 10 is shown having color printing tracks 11 through 14 each capable of providing a different color for printing, resulting in a four-color printer. Ribbon 10 is housed in a ribbon cassette 15 which rests on a ribbon support frame 16. Therefore, by shifting the ink ribbon along its widthwise direction, the black 11, red 12, blue 13, and green 14 color tracks can each be set at the height of the print head, allowing each color to be used in printing.

The ribbon selection mechanism in this printer shifts ink ribbon 10 vertically up and down by raising and lowering ribbon support frame 16 on which the ribbon cassette rests. One side of the printer, which is on the right side of FIG. 1 and labeled as side II and shown in greater detail in FIG. 2, is referred to as being adjacent to a first print head path end. A ribbon track selection or setting member 40 is disposed on side II of the printer and used to vertically displace ribbon frame 16. A second, opposite side of the printer, which is shown on the left side of FIG. 1 and in FIG. 3, is labeled as side III and referred to as being adjacent to a second print head path end. A printing track release member 50 is disposed on side III of the printer and used to release printing track setting member 40 and ribbon frame 16 from a particular set or selection position.

A pair of protrusions 71 and 72 are mounted or otherwise formed on opposite sides of carriage 3, and extend outward toward sides II and III, respectively. The extension of protrusion 71 is used to interact with a setting drive end 41 of track setting member 40 and to drive or activate the setting member, so it may be referred to as a setting protrusion. The extension of protrusion 72 is used to contact a release drive end 51 of track release member 50 and to drive or activate the release member so it may be referred to as a release protrusion.

As shown in FIGS. 4 and 5, a pivoting connection or joint 73 is formed on a side of the roughly rectangular-shaped ribbon support frame 16 which is attached to printer base 8 using this joint. A frame setting spring 74 is connected between printer base 8 and ribbon frame 16 adjacent to joint 73 which continuously biases or pulls frame 16 downward toward printer frame 8. Ribbon frame 16 pivots or swings about joint 73 which shifts an end member on the opposite side up and down. Track setting member 40, on side II, and track release member 50, on side III, are positioned next to and on opposite sides of ribbon frame 16 on printer base 8. Members 40 and 50 interact with portions of ribbon frame 16, causing it to pivot about joint 73, which in turn causes ink ribbon 10, exposed from ribbon cassette 15, to be moved up or down.

A termination slot or stop aperture 75 is formed on a lower planar portion of ribbon frame 16 adjacent to side II and is configured to interface with track setting member 40 to prevent further movement of frame 16, and is described further below. A ribbon drive shaft 76 also passes through a hole in ribbon frame 16 and into a receiving slot in ribbon cassette 15 where it interacts with and winds ink ribbon 10.

Using the above configuration, printer head 1 is moved back and forth along main guide share 2 by carriage 3 drive motor 5 using timing belt 4, and protrusions 71 or 72 come into contact with setting drive end 41 and release drive end 51, respectively. Protrusion 71 comes into contact with and pushes against setting drive end 41 when carriage 3 is moved into a non-printing zone adjacent to side II. As a result, track setting member 40 interacts with carriage 3 through setting drive end 41 and raises ribbon frame 16 where it is stabilized at a new height by stop aperture 75. When carriage 3 moves to a second non-printing zone adjacent to side III, protrusion 72 comes into contact with and pushes against release drive end 51 of track release member 50. As a result, track release member 50 raises frame 16 up. Therefore, the setting of track setting member 40 is released, and setting member 40 is returned to a position prescribed by release spring 46. After setting member 40 completely disengages ribbon frame 16 and carriage 3 moves to a position where it is not in contact with release drive end 51, the ribbon frame is returned to an initial position by frame setting spring 74.

Figure 6:
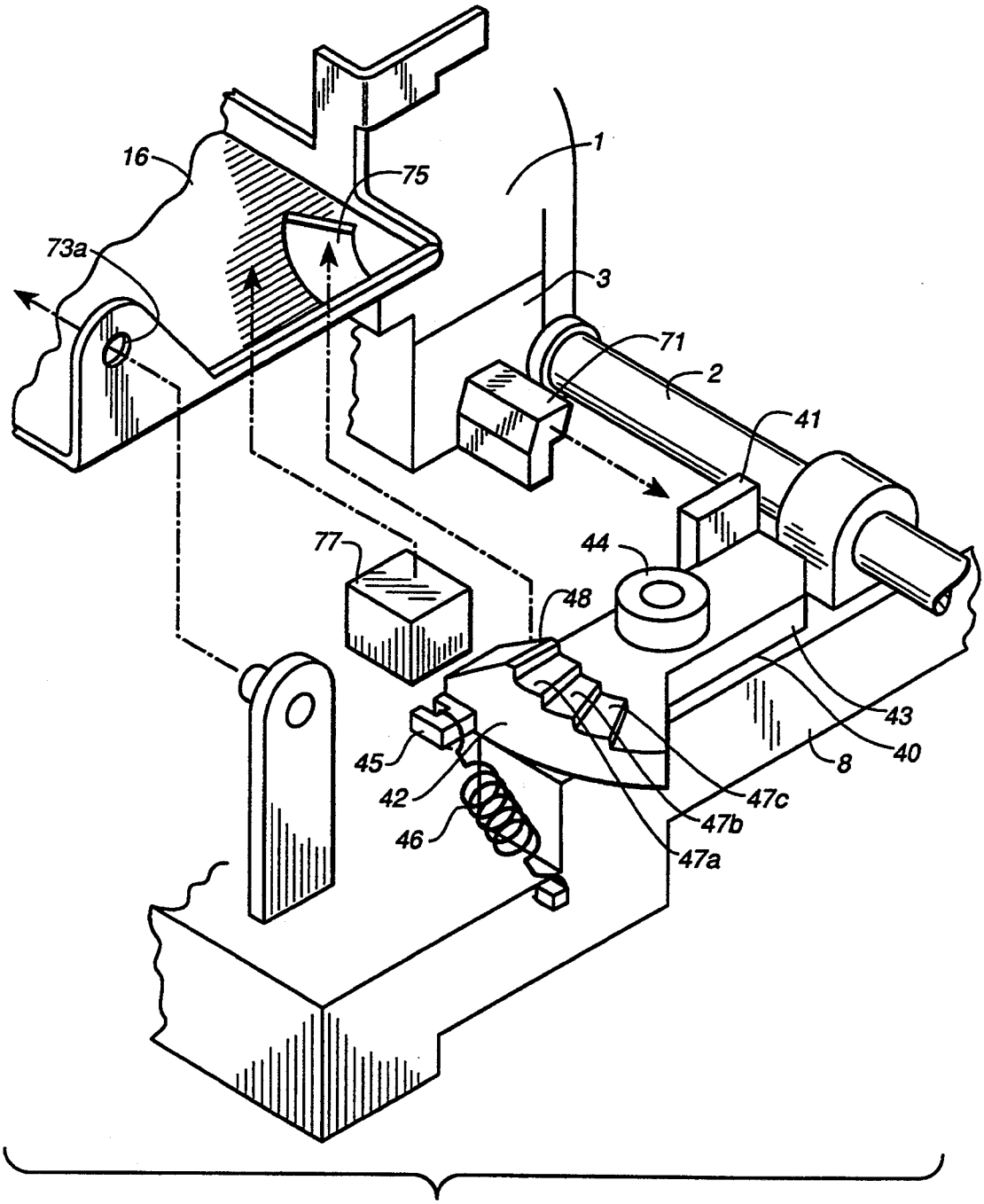
FIG. 6 illustrates an enlarged portion of side II of the printer of FIG. 1 which has a ribbon track selection mechanism.
Figure 7:
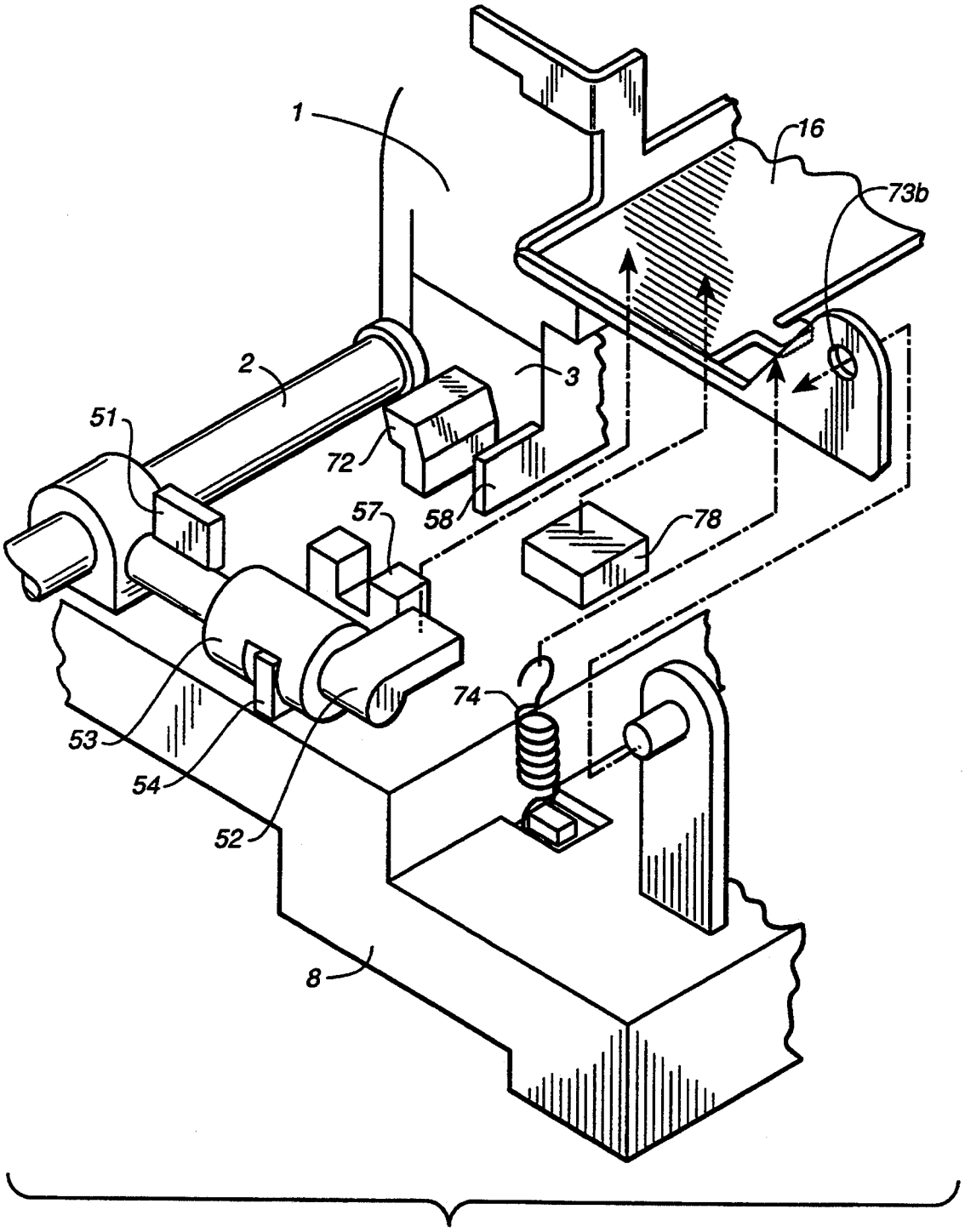
FIG. 7 illustrates an enlarged portion of side III of the printer of FIG. 1 which has a ribbon track release mechanism.

The configuration and operation of ribbon track setting and release members 40 and 50 are now described in further detail in relation to the illustrations of FIGS. 6 and 7. Elements useful for realizing track setting member 40 are shown in FIG. 6 where track setting member 40 is configured as a generally rectilinear or bar-shaped setting lever 43, which is mounted on printer frame 8 using a pivot pin. Setting lever 43 is capable of rotating or pivoting about a rotational axis or pivot point 44 which has a central axis that projects substantially perpendicular to the surface of printer base 8. Setting drive end 41 is formed as one end of setting lever 43 and may include a reinforced or shaped projection for interacting with protrusion 72. A shift end 42 is formed on the other end of setting lever 43 and swings in an opposite direction from drive end 41. Shift end 42 inserts between ribbon frame 16 and printer base 8, at least during part of its rotation, A release spring 46 is connected between an end tab 45 of shift end 42 and printer base 8. Shift end tab 45 can be configured as a projection or spring bracket with a slot or similar aperture for securing one end of spring 46.

As illustrated in FIG. 6, the shift end 42 portion of setting lever 43, is configured to provide three different setting levels or ribbon track positions. This is accomplished by forming a series of step-like stops or ledges in setting lever 43 end 42. In FIG. 6, there are three steps or three setting levels 47*a*, 47*b*, and 47*c* positioned above the base height or surface of lever 43, which correspond to three of the color tracks 12, 13, and 14 on ink ribbon 10. However, those skilled in the art will recognize that this is not a limitation of the invention and that more or fewer setting levels or stops can be employed as desired. Setting level stops 47*a* to 47*c* are preceded by a wedge-shaped terminal step 48 on the outer edge of shift end 42 which first contacts frame 16. Stops 47*a* to 47*c* are formed such that their heights become sequentially lower moving away from wedge-shaped terminal step 48.

Therefore, when protrusion 71 presses against setting drive end 41, lever 43 rotates so that shift end 42 is inserted between ribbon frame 16 and printer base 8. Initially, the sloped face of terminal step 48 pushes frame 16 vertically upward. After lever 43 has rotated a short distance, terminal step 48 engages stop slot 75 which provides clearance for step 48 and frame 16 drops back down until it encounters the highest setting level stop, which is level stop 47*a*. This sets ribbon frame 16 at the highest ribbon track position. As protrusion 71 continues to press against setting drive end 41 and rotate lever 43 even farther, shift end members 42 is inserted or slides farther into stop slot 75 which now receives first level stop 47*a* and allows the second highest setting level, 47*b*, to engage ribbon frame 16, which is set to the second ribbon track level. Continued pressure from protrusion 71 against setting drive end 41, results in shift end member 42 moving farther along stop slot 75 so that the third highest setting level 47*c* engages ribbon frame 16 to establish a third ribbon track level. In this manner a series of vertical height settings are imposed on ribbon frame 16 while it is stabilized by shift end 42 engaging in stop aperture 75. In this configuration, stop hole 75 functions as a shift end setting element.

As will be described below, to return ribbon frame 16 to lower track levels, ribbon frame 16 is raised between setting lever stop 47*c* and stop 47*b*, or stop 47*b* and stop 47*a*, or over terminal step 48, by track release member 50, while shift end 42 is retracted from under ribbon frame 16 by release spring 46. At each level shift, the next level stop, 47*c*, 47*b*, 47*a* is engaged by the edges of stop slot 75. Therefore, ribbon frame 16 is set at the next highest level each time it is raised and lever 43 is rotated by the force of spring 46. In this manner, the track height of ribbon frame 16 is gradually set higher as ribbon frame 16 is lifted higher by track release member 50. When ribbon frame 16 is lifted the last time above setting level step 48, shift end 42 is removed from or completely disengages stop slot 75 and ribbon frame 16 is reset to its initial, lowest, track position. Therefore, ribbon frame 16 is pulled down as far as it will go by frame setting spring 74 and is held stable by a frame holder 77 positioned on printer base 8. In this manner, ribbon frame 16 can be set at four different track heights or levels by track setting member 40, using a base setting plus three level stops.

A track release member 50 useful for implementing the invention is shown in FIG. 7. In FIG. 7, track release member 50 is shown employing a release shaft 53 mounted with a longitudinal axis substantially parallel to printer base 8 and perpendicular to main guide shaft 2. Release shaft 53 is typically mounted on printer base 8 using a stopper protrusion 54 having a hole that receives an axial portion of release shaft 53. In the alternative, more than one end bracket could be employed for supporting axial extensions from the ends of release shaft 53 to provide support. Release shaft 53 has a release drive end 51 formed as a lateral extension, tab, or lever on one end adjacent to main drive shaft 2 and a release lever 52 formed on the opposite end. The extension on release drive end 51 is typically formed with an axial offset or tangential projection and extends generally perpendicular to the path of protrusion 72 so that shaft 53 is rotated by applying pressure to a surface of the extension. In the alternative, a portion of release shaft 53 can be removed to provide a notch with a flat surface that is projected along, or offset from, a radius of release shaft 53 and can interact with protrusion 72. This latter arrangement is more compact.

Release lever 52 extends outward from a generally centered axial position. However, it will be readily apparent to those skilled in the art that lever 52 can be axially offset or angled outward from shaft 53 using a variety of configurations within the teachings of the invention. Lever 52 is configured using known relationships to efficiently interact with ribbon frame 16 and provide an appropriate leverage of force to lift frame 16 without unduly burdening the carriage drive system.

As carriage 3 approaches release shaft 53, protrusion 72 presses against the extension on release drive end 51 and causes release shaft 53 to rotate about its central axis, or generally perpendicular to printer base 8. This rotation is accompanied by an outer end of release lever 52 also rotating or pivoting upward against the underside of ribbon frame 16. This pushes a portion of the ribbon frame upward, causing it to pivot on joint 73 (joints 73*a* and 73*b*) against the force of frame setting spring 74. Therefore, as described above, shift end 42 which is temporarily engaged in stop slot 75 of ribbon frame 16 is released, from the downward pressure of frame 16, pivots as far as at least the next setting stop, and the height of ribbon frame 16 is changed. Frame supports or holders 77 and 78 are provided on base 8 under, and at the lower most position of, ribbon frame 16 near track setting and release members 40 and 50, respectively, for stabilization.

The operation of track setting and track release members 40 and 50 is explained in further detail below in relation to FIGS. 8 and 9. Print head positions as related to a method of operation for selecting one or more color tracks using the track setting mechanism are also shown in FIG. 8.

Figure 8A:
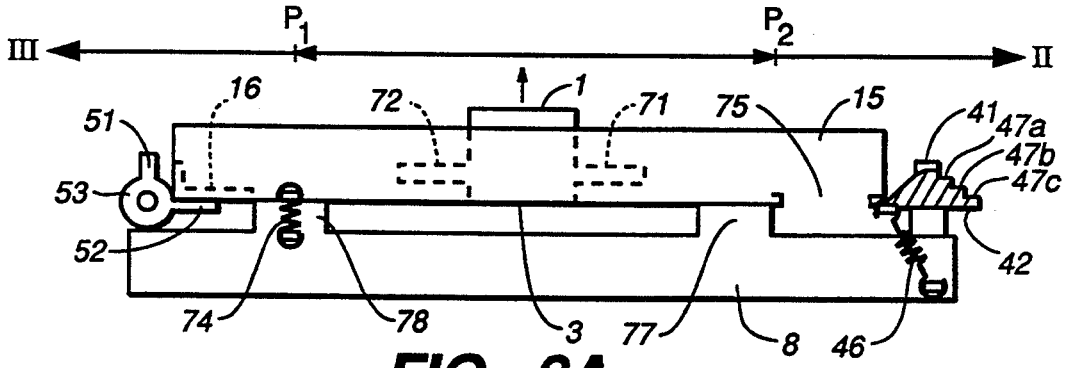
FIGS. 8A, 8B, 8C and 8D illustrate the relationship of operating steps used in selecting ribbon tracks in the printer of FIG. 1 to the printer apparatus.

Ribbon frame 16 is shown in a stable condition at its lowest position in FIG. 8A. This is the position in which ribbon frame 16 rests on frame holders 77 and 78. When print head 1 moves back and forth between two positions $P_1$ and $P_2$, which define the ends of a print-enabled zone or region, or printing area in this configuration, the highest ribbon track 11, black in this example, is set to be at the same height as the printing structure of print head 1 and printing is performed in the color black. This is considered a base ribbon track level setting. Positions $P_1$ and $P_2$ are located near sides II and III or the second and first print head path ends, respectively.

Figure 8B:
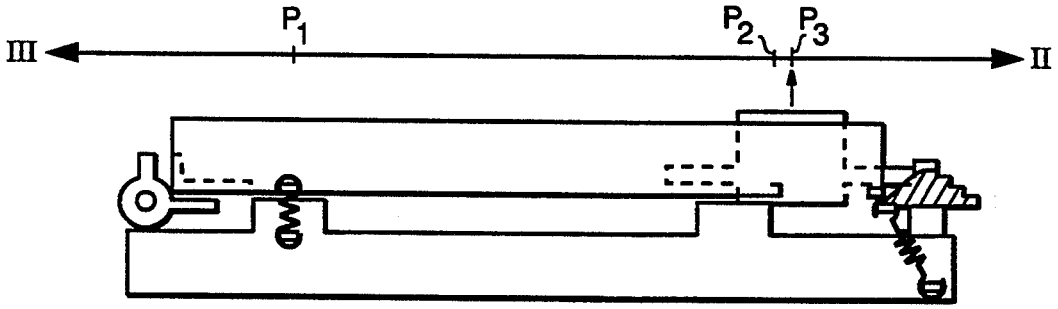
Figure 8C:
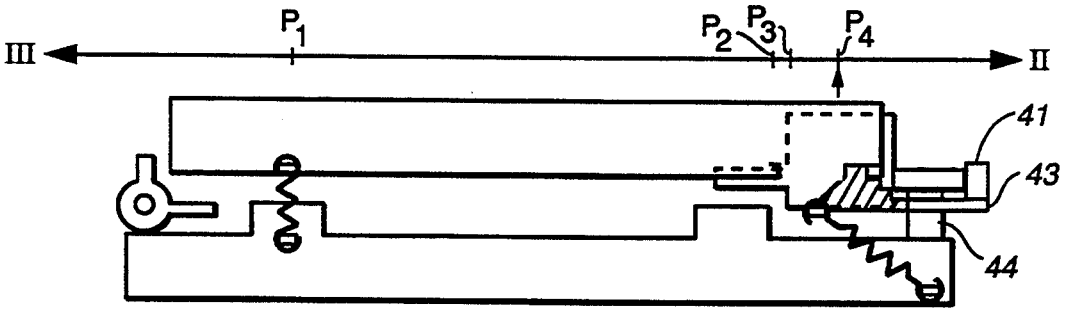

In FIG. 8B, print head 1 is shown after being moved by the line drive means described above to a position $P_3$ within a non-printing zone or region closer to side II than position $P_2$. In this configuration, protrusion 71 makes contact with setting drive end 41 and begins to move track setting member 40 from its current position. Next, as shown in FIG. 8C, as print head 1 moves to a position $P_4$ which is even closer to side II than position $P_3$, protrusion 71 presses against setting drive end 41 and causes setting lever 43 to rotate farther about pivot 44. As a result, shift end member 42 is inserted into stop slot 75 as far as first setting level stop 47*a* and ribbon frame 16 is set at its highest position which sets the lowest ribbon track 14, green in this example, at the height of print head 1. Therefore, printing is performed in the color green (14) until a new color is selected either by moving print head 1 closer to side II than position $P_4$ or through resetting operations described below.

Figure 8D:
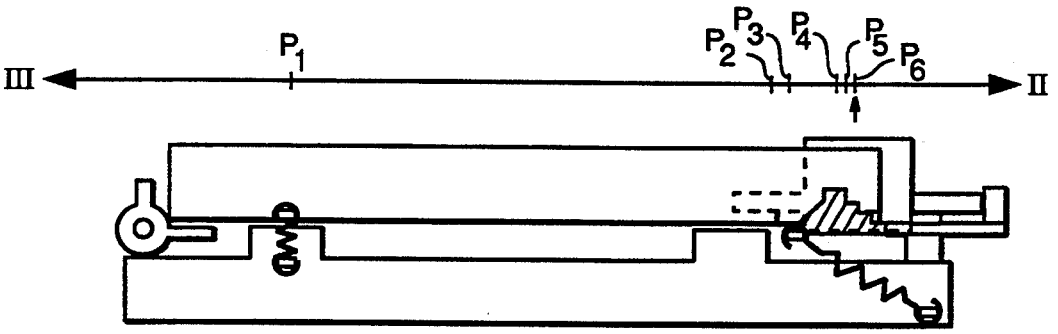

In FIG. 8D, print head 1 is shown after being moved closer to side II into a position $P_6$, and shift end member 42 is then inserted completely into stop slot 75 beginning with first setting level stop 47*a*, past second setting level stop 47*b* to third setting level stop 47*c*. Therefore, ribbon frame 16 is set at the third stop or height from the top (second from the bottom), and second track 12, red in this example, is set at the height of print head 1 and printing is performed in the color red. In FIG. 8D, print head 1 is shown after being moved to a position $P_6$, but if movement is stopped at position $P_5$ situated between positions $P_6$ and $P_4$, then ribbon frame 16 is set at the second setting level on setting level stop 47*b* and the third ribbon color track 13, blue in this example, is selected.

Figure 9A:
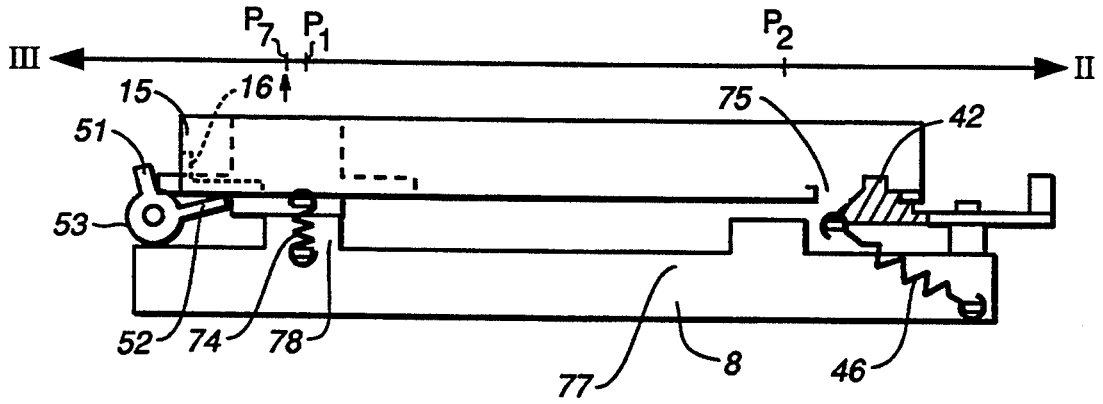
FIGS. 9A, 9B and 9C illustrate the relationship of operating steps used to release tracks in the printer of FIG. 1 to the printer apparatus.

Print head positions related to a method for moving print head 1 toward side III and selecting a color track using the track release mechanism are shown in FIG. 9. First, as shown in FIG. 9A, print head 1 is moved toward side III until it reaches a position $P_7$ in the second non-printing zone. In position $P_7$, protrusion 72 engages release drive end 51 and the release drive end member begins to rotate. As release drive end member 53 rotates, release lever 52 also pivots upward against the underside of ribbon frame 16. When ribbon frame 16 is raised slightly above second setting level 47*b*, engagement between stop hole 75 and shift end member 42 is released and shift end member 42 is pulled back by release spring 46. As a result, ribbon frame 16 is raised from the third to the second position from the top as shown in FIG. 8D, where it is set. When print head 1 moves toward side II with ribbon frame 16 in this position, track 13 is selected for printing as desired. In the previous example, this results in the color blue being used while printing is performed.

Figure 9B:
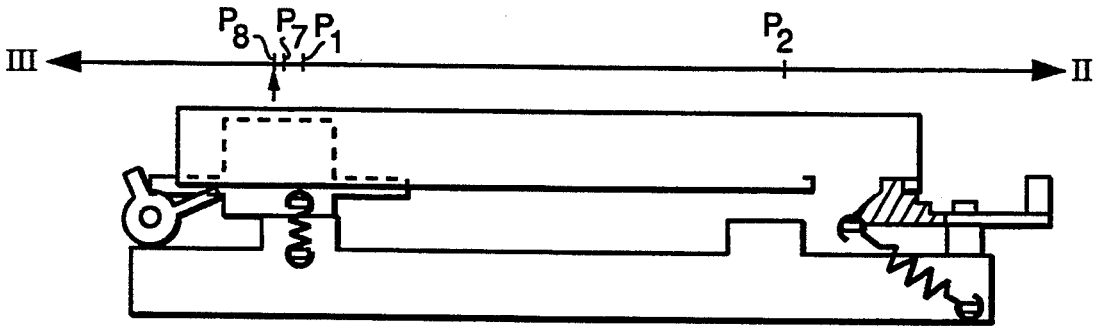

As shown in FIG. 9B, when print head I is moved closer to side III than position $P_7$ and arrives at a position $P_8$, release drive end member 53 and, thus, release lever 52, is rotated even farther, and ribbon frame 16 is lifted higher to a vertical position slightly higher than first setting level stop 47*a*. In this position, shift end 42 is pulled back or retracted farther along slot 75 until it is stopped in stop aperture 75 at setting level 47*a*. Therefore, track 14 is selected and printing in green is performed.

Figure 9C:
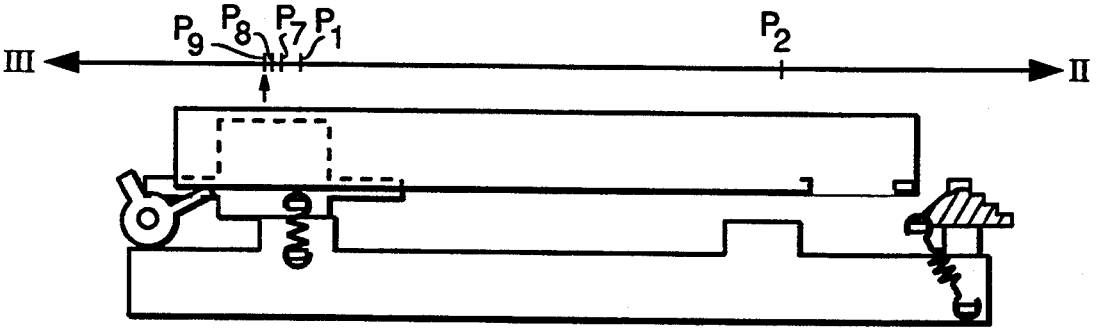
Figure 10:
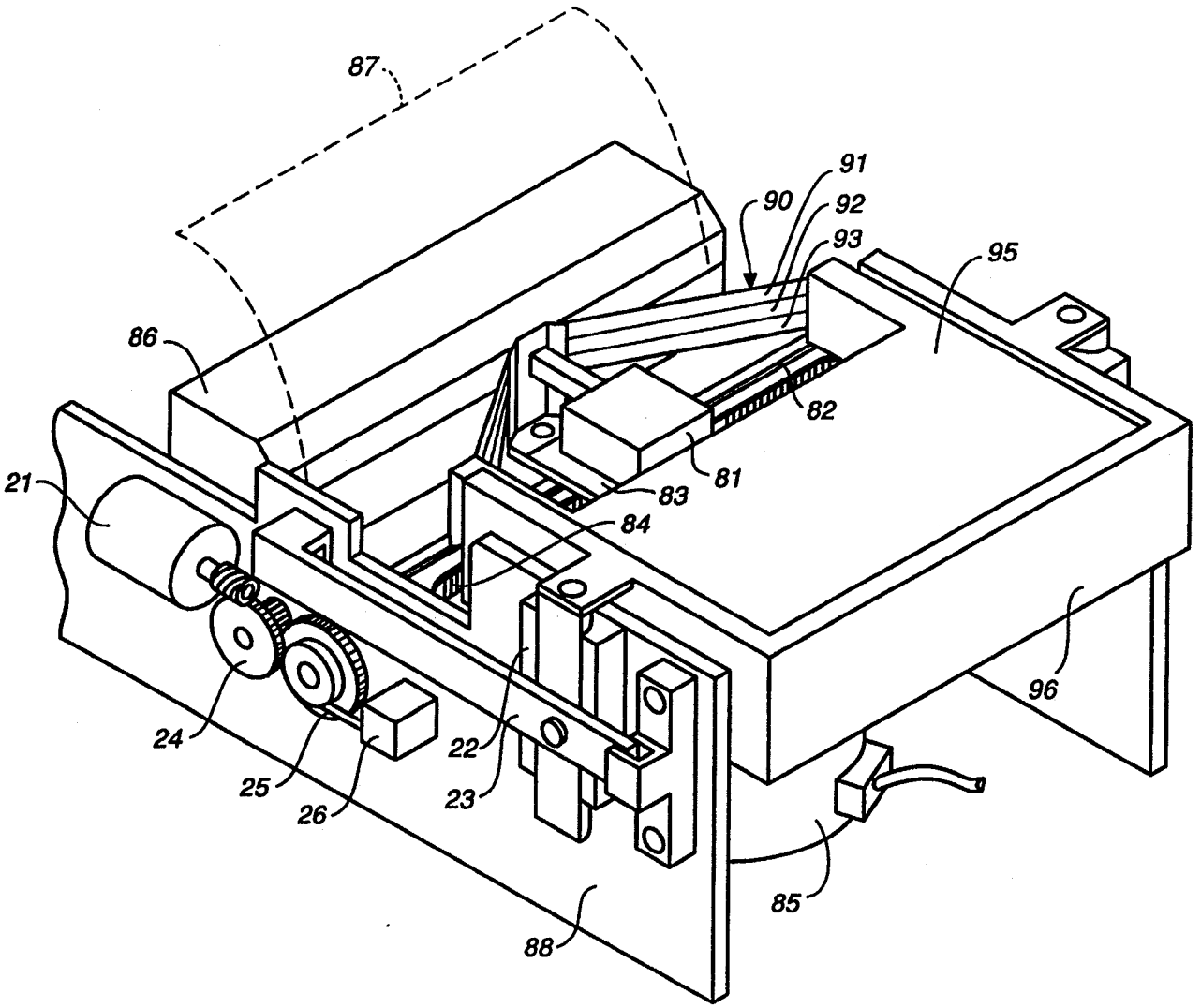
FIG. 10 illustrates a perspective view of a switching mechanism useful for selecting color ribbon tracks in a prior art printer.
Figure 11:
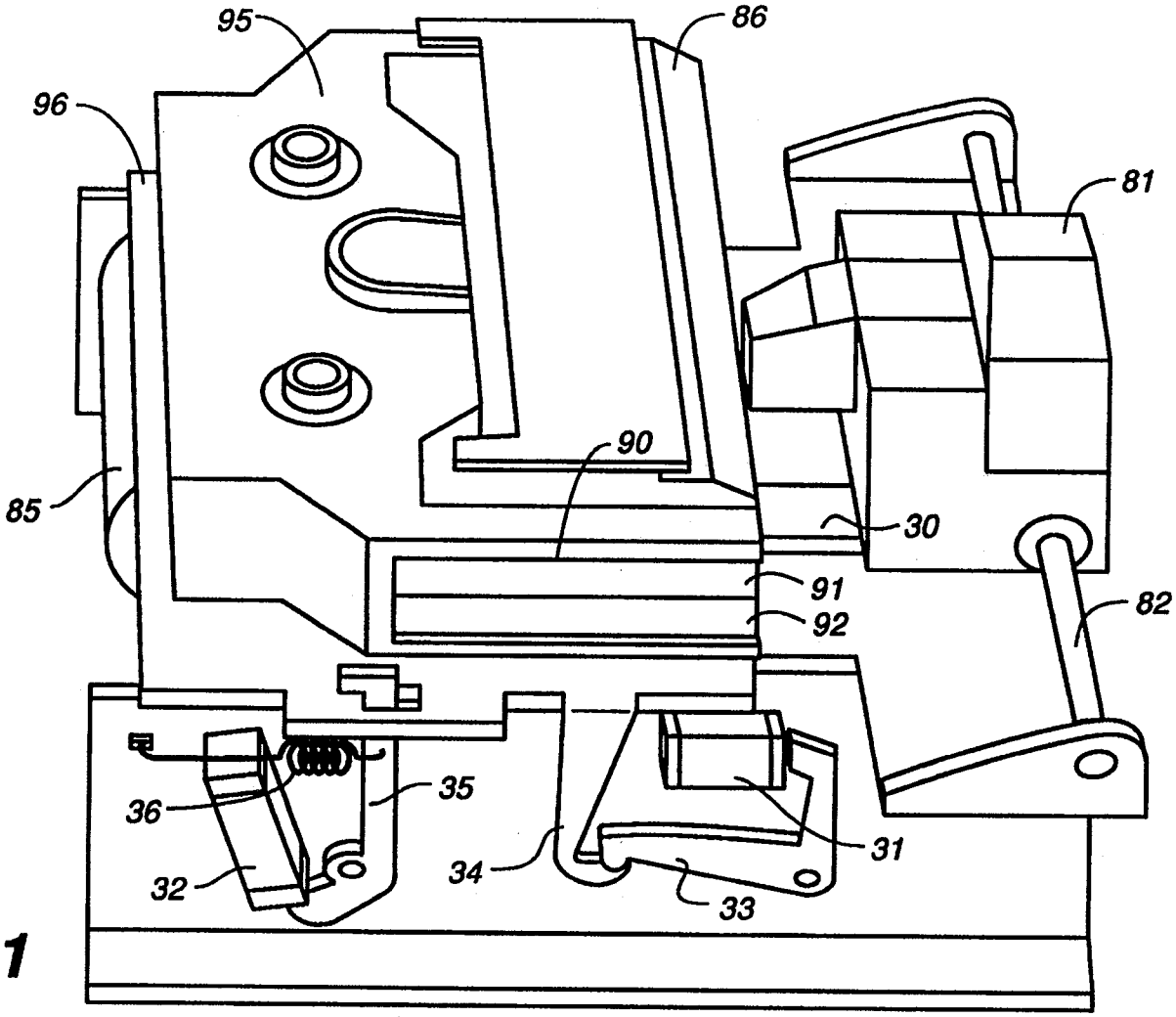
FIG. 11 illustrates a perspective view of another switching mechanism useful for selecting ribbon tracks in a prior art printer.

As shown in FIG. 9C, when print head 1 arrives at position $P_9$ which is closer to side III than position P8, ribbon frame 16 is pushed higher than the highest part (48) of shift end 42. Therefore, all engagement with stop slot 75 is released and shift end member 42 is pulled back completely by release spring 46 to its initial position where it is disengaged from ribbon support frame 16. As a result, ribbon support frame 16 returns to its lower most position where it is stabilized by frame holders 77 and 78. In this configuration, printing is performed in black using track 11.

In this manner, the printer of this embodiment makes it possible to change tracks utilizing the movement of the print head in non-printing zones or regions of the print head path. Therefore, an independent motor, solenoid or other drive component for changing ribbon tracks is not required, making it possible to manufacture a lighter printer with a simplified structure. Ink ribbons having many color tracks can be easily installed or replaced since they are enclosed in a ribbon cartridge, and any of the tracks can be easily selected in a brief time by quickly moving the print head to respective non-printing zone positions.

Protrusions formed on the carriage for setting and releasing the ribbon frame 16 height were disclosed above, but these protrusions can also be formed on the sides of the setting and release drive end members as desired. It is only necessary to have elements or surface structures that make contact between the carriage and the end members to properly engage each other and provide the appropriate transfer of lateral carriage movement to the associated levers.

In addition, an embodiment was described employing a shift end member capable of accommodating four color tracks, but five or more tracks can also be accommodated using a similar structure by simply increasing the number of setting level stops. Of course, fewer color tracks, say two or three, can be accommodated by decreasing the number of setting level stops on the shift end member. The main body of the color track selection or setting device is illustrated as being a lever that pivots in a plane parallel to the ribbon frame. It is also shown as utilizing a series of level stops that ascend in height from underneath the ribbon frame. However, the invention is not limited to this configuration and a rotating element similar to the release member may be employed which is rotated by interaction with the carriage in a direction perpendicular to the ribbon frame to move the ribbon frame up and down. The converse is also true in that the release lever can employ a pivoting type lever to establish a release height.

While ribbon selection is shown as involving moving the ribbon frame up by inserting a shift end member from below the ribbon frame, this is not a limitation of the invention, and ribbon selection can be performed by inserting a shift end member from above the ribbon frame and moving the ribbon frame downward. At the same time, other elements besides the stop slot, such as but not limited to a cam or other temporary stop member, can be employed, in which case it is easy to drive this cam or other temporary stop member using a release lever.

Also in this embodiment, the shift lever, release lever and other track setting and release mechanisms are driven by pressure form the print head carriage, but it is also possible to drive these mechanisms from the carriage drive motor using gears, cams, belts, etc. In this case, since the amount of rotation of the carriage drive motor shaft corresponds in a one-to-one relationship with the amount of movement imparted to he carriage, the track setting and release mechanisms can be driven in concert with operation of the carriage outside of the printing zone. Of course, the invention is not limited to printers in which the carriage is driven on a guide shaft by a carriage drive belt, and the shift mechanism can also be applied to printers, or other devices that drive a carriage using a drive arm as in prior art examples.

The ink ribbon used in this embodiment is illustrated as a multicolor ribbon, but a single-color multi-track ribbon can also be used. By using this kind of ribbon, a compact, lightweight printer can be realized that requires little or no maintenance for long periods of time other than re-supplying recording paper.

Figure 12:
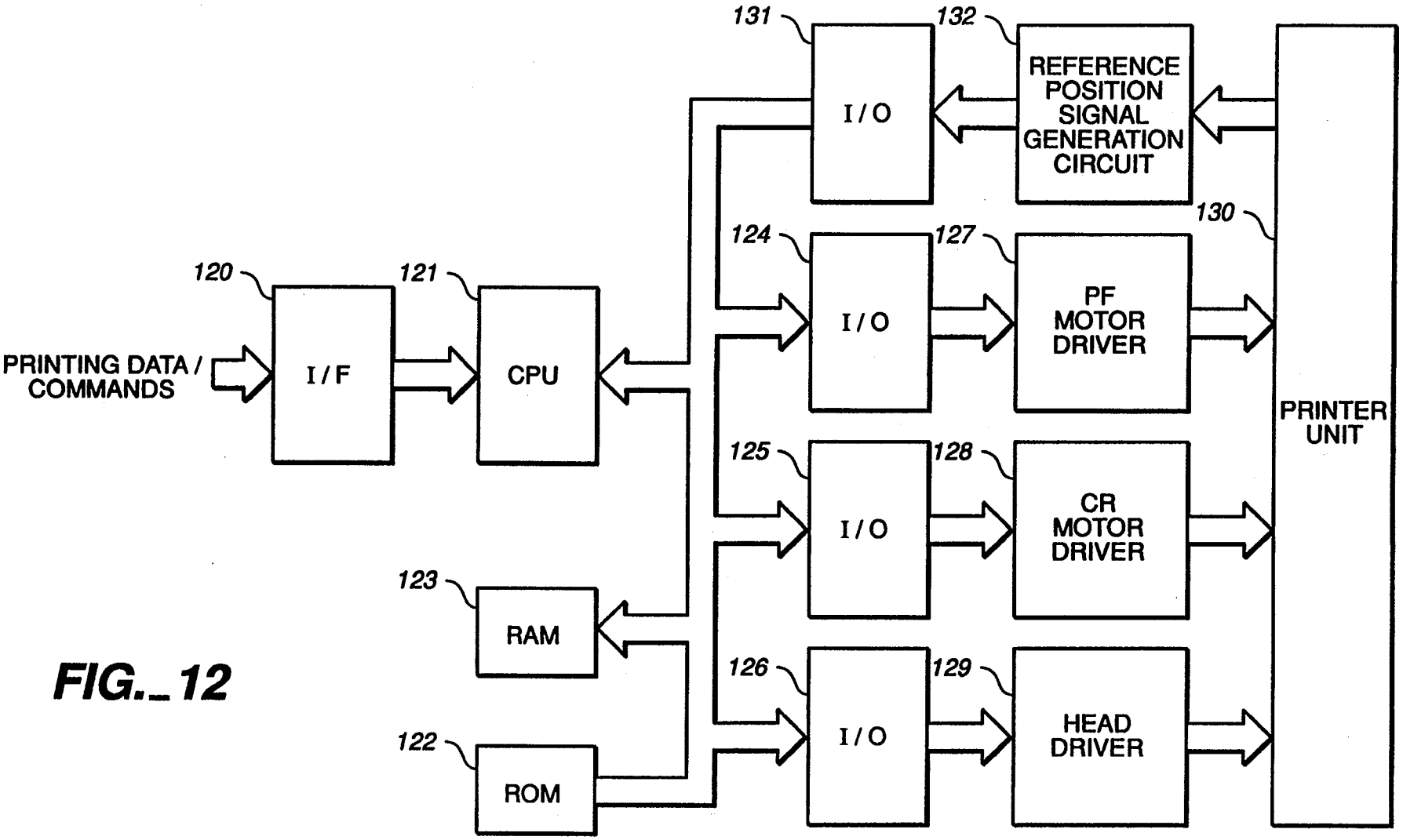
FIG. 12 illustrates a schematic of a control device useful for operating the printer of FIG. 1.

A control method for ink ribbon color track selection or shifting, i.e., ribbon switching which is useful for implementing the present invention is illustrated starting at FIG. 12. FIG. 12 shows a block diagram of a control device for the various mechanisms or elements used in the printer embodiment disclosed above. In the structure of FIG. 12, a CPU 121 is used to perform overall control of printer operations and mechanisms, etc., a ROM 122 is used to store control programs and various types of data, a RAM 123 is used which includes a memory section or portion for printing color memory, and an interface 120 is used to receive print data and commands from a host computer or similar device wanting to use the printer.

Signals for driving a paper feed (PF) motor driver 127, a carriage or carriage return (CR) motor driver 128, and a head driver 129, are output through a series of I/O ports 124, 125, and 126, respectively. Paper feed and carriage motor drivers 127 and 128 and head driver 129 are connected to the paper feed motor, carriage motor, and print head, respectively, which are each housed within printer unit 130, and control their respective operations based on signals received from CPU 121. A reference position signal generator or generation circuit 132 also processes a signal from a reference position detector mounted in printer unit 130 and sends a reference position signal through an I/O port 131 to CPU 121. A flowchart of a track selection operation performed by this control system is illustrated in FIG. 13.

Figure 13:
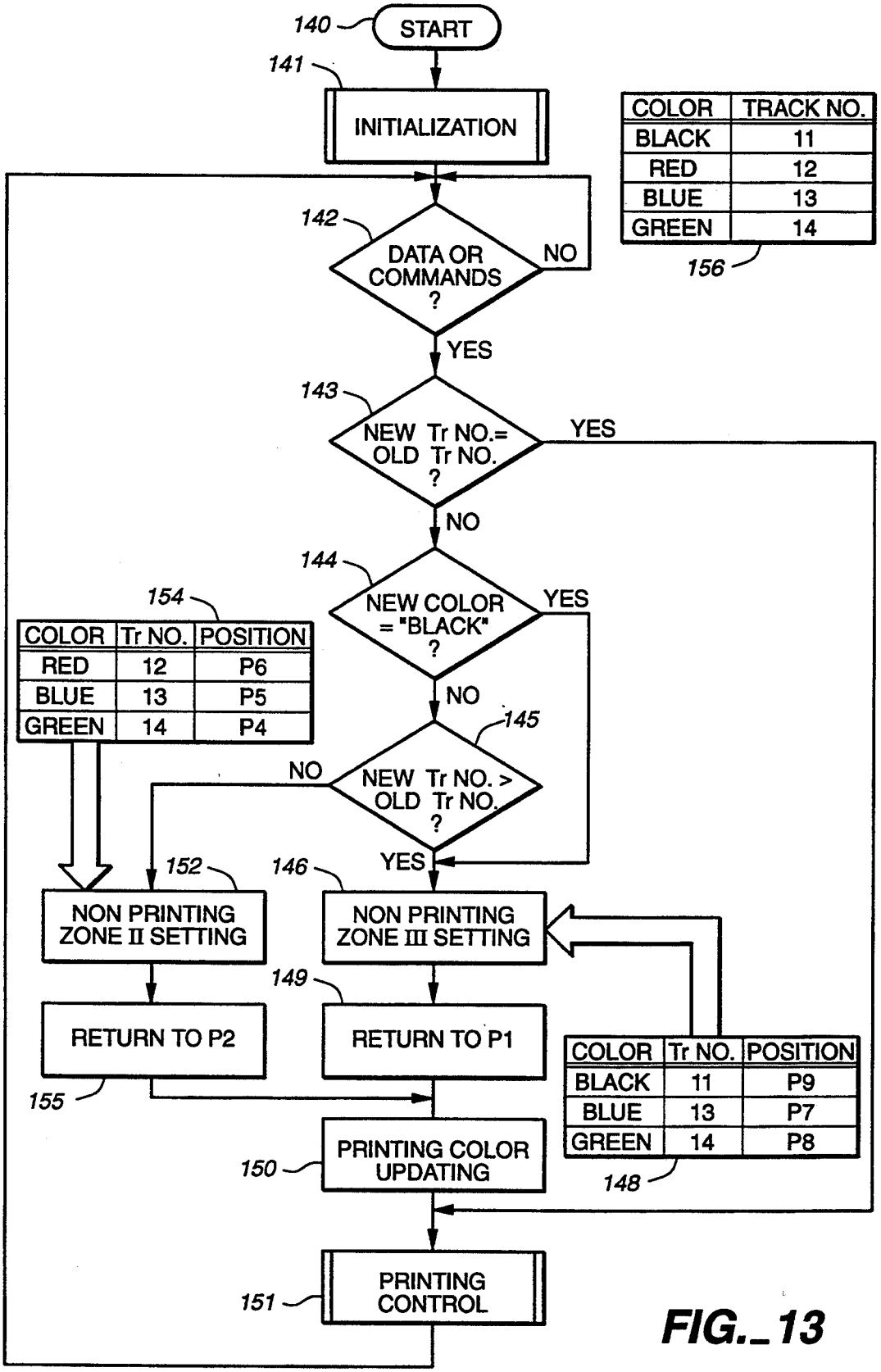
FIG. 13 illustrates a flowchart for a ribbon track selection control method.

As shown in FIG. 13, a table 156 shows the relationship between the track numbers or relative positions on a multi-color multi-track ink ribbon and the respective colors used for printing. For the sake of convenience, the track numbers are the same as those used in earlier examples, although this is not a specific feature or limitation of the invention. When the printer is first provided with power or placed in an ON state, an initialization control process is started, as in a step 140.

During a printer initialization step 141, carriage motor 5 is operated to move print head 1 on carriage 3 to position $P_9$, which selects a basic color (black) for use in printing operations. In this example, a value representing track number 11, which corresponds to black, is then stored in the printing color memory to indicate the last color selected for printing. Print head I is then moved to printing start position $P_1$, typically at the left side of the printer, and the printer enters a standby mode in a step 142. In the standby mode, 142, the printer waits for data or instructions.

Whenever print data or commands are received from the host computer, through interface 120, while the printer is in standby mode, a color determination procedure is initiated to determine if a new color track is to be selected or set before printing begins. First, in a track comparison step 143, the newly specified track number is compared to the previously selected track number stored in color memory. That is, during track number comparison step 143, the new printing color is detected from received print data or commands, after which the track number corresponding to the new color (new track number below) is compared with the track number corresponding to the old (current) color (old track number below) stored in the printing color memory section. If the old and new colors are the same, same track numbers, then no change is made in the color memory designation and printer control proceeds to a printing or print head control step 151 in which data is passed to the print head for image formation.

On the other hand, if the new color request differs from the previous selection, the track number for the new color is compared to the track number corresponding to black in a comparison step 144. If the two colors compared in step 144 are the same, i.e., new printing color is to be black, the process proceeds to a non-printing zone III setting step 146, skipping non-printing zone selection step 145. This exception or jump execution is specific to the shape of the shift end of the track setting member, and allows initialization of the track setting mechanism when black is newly selected as a color.

When the new printing color is not black, the new and old track numbers are compared in a non-printing zone selection step 145, and if the new track number is larger than the old track number, the print head is moved to non-printing zone III in a setting step 146. Otherwise, the print head is moved into non-printing zone II in a setting step 152. In non-printing zone setting step 146, the print head position that corresponds to the new color track number in non-printing zone III from table 148 is selected, and the track release mechanism is operated accordingly and the new ribbon track set at the height of the print head. This is achieved by moving the print head to the corresponding setting position. An increase or decrease in the number of printing colors can be easily accommodated by rewriting tables 148 and 154.

Generally, a printer has a home position for the print head, a position the print head is set in when the printer is first powered ON, and subsequent movements of the print head are performed using this position as a reference. Therefore, since the position of the print head relative to its home position is already known, the direction and distance the print head is moved can be easily obtained by making the positions provided in table 148 relative positions with respect to the home position. Following this, the print head is moved to position $P_1$, the printing start position of the print-enabled zone near side III (Step 149), and a printing color update step 150 is performed.

In non-printing zone II setting step 152, a print head position that corresponds to the new track number in non-printing zone II from table 154 is selected, and the print head moved to the corresponding set position, whereby the track setting mechanism is operated and the appropriate new ribbon track set at the height of the print head. Following this, the print head is moved to position $P_2$, which is the printing start position of the print-enabled zone near side II of the printer (Step 155), and a printing color update step 150 is then executed.

In track update step 150, the new track number is stored in the printing color memory and printer control then proceeds to printing control step 151, as before. During execution of step 151, printing is performed using the color selected and set by the above procedure. Upon completion of printing, the printer is again placed in the standby mode, as in step 142, where it waits and checks for the receipt of data or commands for printing.

A method for correcting the print head position during track setting and release operations is discussed next. In this embodiment, the printing start position $P_1$ near side III of the printer within the printing-enabled zone is treated as the print head "home" position. Those operations and steps performed to position the print head in the home position are referred to collectively as a printing position initialization procedure, which is discussed below.

A photodetector 57 is mounted on printer base 8 and used to detect a reference position for initializing the print head position. Detector 57 is typically configured as a general purpose photo-interrupter type of detector which has one portion for emitting an optical beam and another for detecting the presence or absence of the beam. A typical photodetector 57 structure is U-shaped with the open portion of the U allowing insertion of material to interrupt the optical beam. In the present embodiment, a non-contact, light-blocking shield plate 58 is formed or remounted on one side of carriage II and used to interrupt the optical beam in photodetector 57. When shield plate 58 is inserted between the branches of the U-shaped body and blocks the light path between the light-emitting and detecting elements, a current change (decrease) occurs in a photodetector output signal.

A reference position signal generation circuit 132 receives the output of photodetector 57 and converts it to a voltage signal, typically using a digital binary functional relationship. That is, the reference position signal has a nonactive, out-of-position "low" level state or an active, in-position, "high" level state. The output of circuit 132 is transferred as a reference position signal to CPU 121 through I/O port 131, so that CPU 121 knows when or if the print head is in the reference position.

Figure 14:
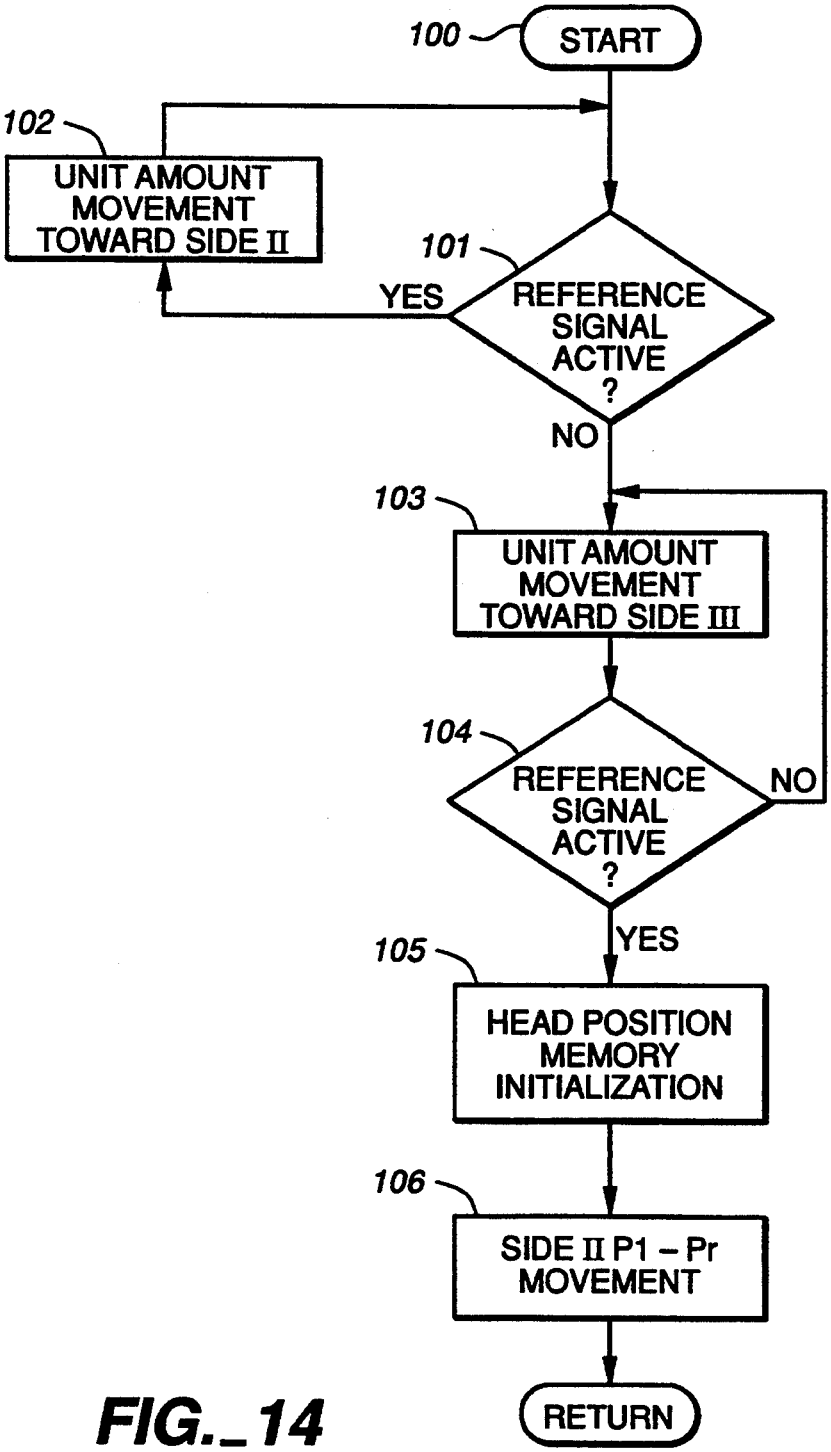
FIG. 14 illustrates a flowchart for a printing position initialization procedure.

A flowchart of processing steps used in a printing position initialization procedure for positioning the print head at position $P_1$, i.e., the home position, is shown in FIG. 14. A unit of measure referred to as a "unit amount" (UA) is used in this procedure and is generally defined as the number of steps that correspond to one step or one cycle of an excitation phase of a stepper motor, or in the alternative, the period of one encoder pulse when using an encoder-equipped DC motor.

The printing position initialization procedure is initiated in a step 100 and the reference position signal is examined in a step 101 to determine its relative voltage level. If the reference position signal is "active" or "high", then the print head is moved, in a step 102, closer to side II of the printer by a unit amount, after which step 101 is revisited and the reference position signal checked again. If the second, or subsequent, examination determines that the signal is now "non-active" or at a "low" level, then the print head is moved, in a stop 103, closer to side III of the printer by one unit amount, and the reference position signal examined again in a step 104. Checking the reference position signal and moving the print head closer to side III, in steps 103 and 104, is repeated until the signal is active, indicating that the carriage has cleared the detector position by a prescribed amount.

Once the reference position signal is determined to be high or active in step 104, then a position value $P_r$ corresponding to the reference position is stored in a head position memory section of RAM 123 in a step 105. Whenever the print head is subsequently moved, a value indicating the current (subsequent) relative position of the print head is continually retained in the head position memory by either adding or subtracting a value corresponding to the amount of movement or displacement from the original reference position. When the print head is moved to the home position $P_1$ by being moved from position $P_r$ toward side II only by an amount equal to the difference between $P_r$ and $P_1$ the printing position initialization process is terminated.

By including the above printing position initialization procedure in a resetting operation or step 149, which is used to place the head in position $P_1$ after non-printing zone III setting step 146 has been executed, the position of the print head can be corrected and printing can be performed at the correct position even if non-printing zone III setting step 146 or print head movement is for some reason completed with errors. Confirmation of the print head position and handling abnormal operating conditions are covered next.

Figure 15:
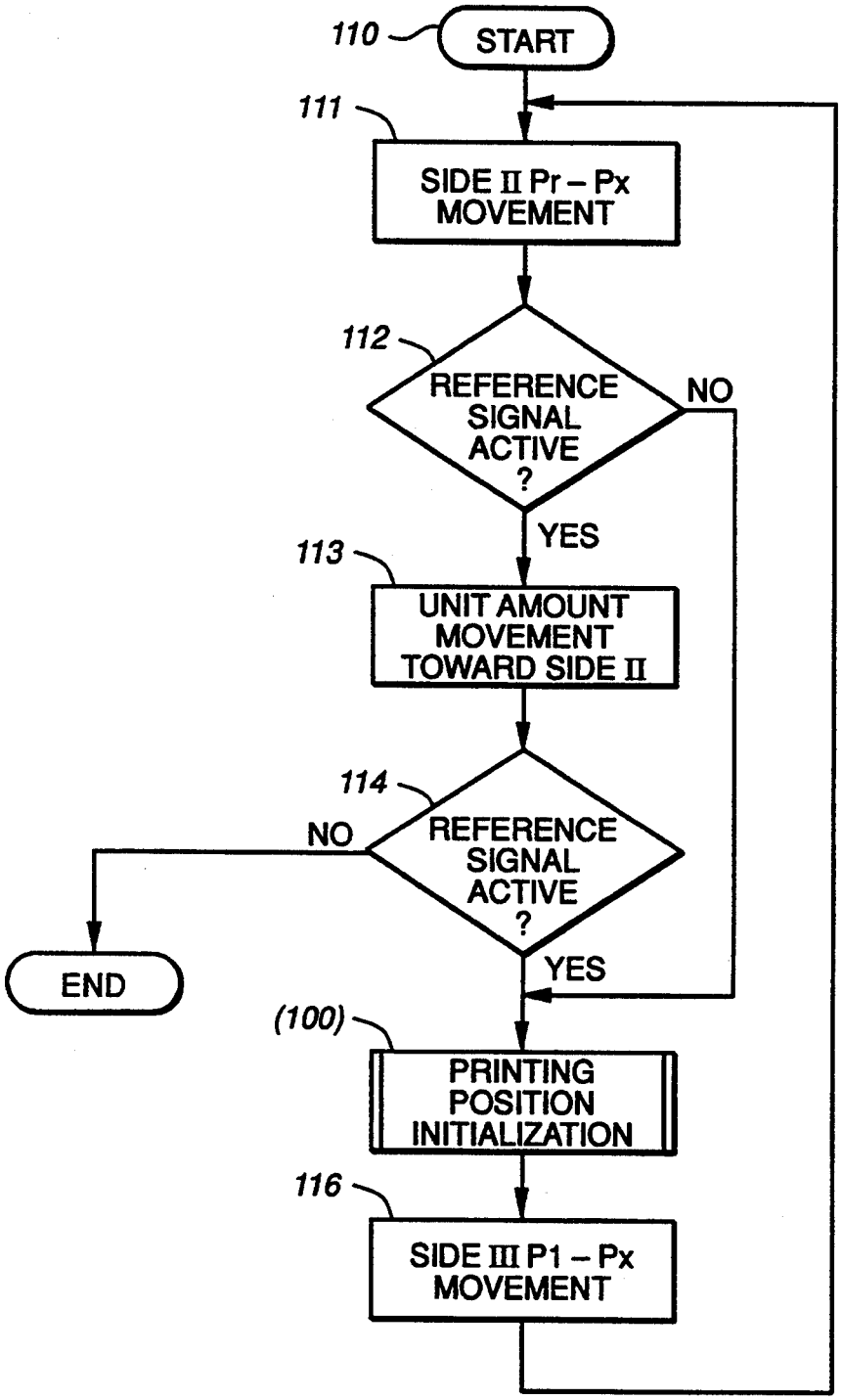
FIG. 15 illustrates a flowchart for a print head position confirmation procedure.

A flowchart of steps found useful in confirming the print head position is shown in FIG. 15, beginning with a step 110. In this embodiment, the printing position initialization procedure is included in resetting operation 149, which is used to place the print head in position $P_1$ after non-printing zone III setting step 146 has been executed, but the same steps can be implemented when the printing position initialization procedure is included in resetting operation 155, which is used to place the print head in position $P_2$ after non-printing zone II setting step 152 is executed.

When the print head position confirmation operation is started in step 110, the print head is moved toward side II of the printer in a step 111, by an amount represented by $P_r - P_x$, where $P_x$ represents the print head position corresponding to the printing color, which is set according to the contents of look-up table 148; e.g., $P_9$ if selecting black. As a result, the print head should have reached the reference position $P_r$. Therefore, if the reference position signal is not active when it is examined in step 112, print head movement is considered as completed with errors and the head position confirmation procedure continues to a step 115 and subsequent steps, for processing related to abnormal conditions. If, however, the reference position signal is active, then the print head is moved toward side II only by the unit amount in a step 113. If print head movement is completed without errors, then that position should be closer to side II than position $P_r$ by one unit amount. Therefore if a non-active reference position signal level is obtained at this point, after checking in a step 114, this is considered normal and the print head position confirmation procedure is terminated.

On the other hand, if an active level is detected after examining the reference position signal in step 114, print head movement is considered completed with errors and processing is performed for an "abnormal condition" In the present example, restarting the printer is performed to compensate for an abnormal condition when print head movement is completed with error. That is, first the position of the print head is initialized by executing the printing position initialization procedure, and then the print head is moved toward side III of the printer by an amount obtained by subtracting $P_x$ from $P_1$ and then proceeding to step 111 at the beginning of the head position confirmation procedure.

While the invention was described using a photo-interrupter and shield plate as a reference position detection apparatus, this is not a limitation of the invention, and a photoreflector and reflector plate, a reed switch and magnet, or other non-contact detection mechanisms, or a limit switch or other contact switches can be used. In addition, although restarting or retrying is performed to accommodate an abnormal operating condition, such as when print head movement is completed with errors, this is not a limitation, and a signal indicating such an abnormal condition or similar status information may be provided as an output to the external computer, or to a display provided on the printer, and used to notify a computer or printer user, to exercise appropriate corrective action. Furthermore, when retrying is used, it is extremely effective to increase the drive torque by changing drive current provided to the motor or the drive method.

As disclosed above, the inventive ribbon track selection mechanism achieves ribbon color track switching in concert with lateral print head movement into non-printing zones or regions of the printer, eliminating any need for a separate dedicated track switching drive system. Therefore, a compact, lightweight printer can be realized through the omission of heavy track selection or drive systems. Furthermore, by eliminating such drive systems, ribbon track selection apparatus is simplified, reducing the number of parts and lowering the production cost of the printer.

These advantages allow a more and more simplified printer configuration as compared to the prior art, especially as the number of color tracks on the ribbon increases. Since ribbon shifting is performed using print head movement to non-printing regions, it is also advantageously possible to control ribbon shifting independently of control over of the print head printing operations, thus facilitating a simple control system.

Even printers that use single color multi-track ink ribbons can easily have respective tracks selected in concert with the amount of lateral print head movement, and a multifunction, lightweight, compact printer can be realized without additional a drive systems. Furthermore, even incomplete carriage movement, such as when there is a loss in synchronization, can easily be compensated for using a position confirmation detector or by restarting the printing operation. Therefore a printer can be realized in which no shift in the printing position due to improper movement at the time of track selection occurs.

A Möbius type ink ribbon can be used as the ink ribbon in combination with the above track switching mechanism to realize longer ribbon life between ribbon changes.

While the invention has been described in conjunction with several specific embodiments, it is evident to those skilled in the art that many further alternatives, modifications and variations will be apparent in light of the forgoing description. Thus, the invention described herein is intended to embrace all such alternatives, modifications, applications and variations as may fall within the spirit and scope of the appended claims.

APPENDIX A

| Numbers Employed in the Figures | |
|---|---|
| 1 | Print head |
| 2 | Main guide shaft |
| 3 | Print head carriage |
| 4 | Timing belt |
| 5 | Carriage drive motor |
| 6 | Platen |
| 7 | Recording paper |
| 8 | Printer base |
| 9 | Paper holder |
| 10 | Ink ribbon |
| 11 | First ribbon track |
| 12 | Second ribbon track |
| 13 | Third ribbon track |
| 14 | Fourth ribbon track |
| 15 | Ribbon cassette |
| 16 | Ribbon support frame |
| 21 | Ribbon switching motor |

APPENDIX A-continued

| Numbers Employed in the Figures | |
|---|---|
| 22 | Guide |
| 23 | Switching arm |
| 24 | Gear |
| 25 | Cam wheel |
| 26 | Position sensor |
| 30 | Drive arm |
| 31 | First solenoid |
| 32 | Second solenoid |
| 33 | Setting rod |
| 34 | Setting arm |
| 35 | Setting hook |
| 36 | Spring |
| 40 | Track setting member |
| 41 | Setting drive end |
| 42 | Shift end |
| 43 | Setting lever |
| 44 | Pivot point |
| 45 | Shift end tab |
| 46 | Release spring |
| 47a | First setting level stop |
| 47b | Second setting level stop |
| 47c | Third setting level stop |
| 48 | Wedge-shaped terminal stop |
| 50 | Track release member |
| 51 | Release drive end |
| 52 | Release lever |
| 53 | Release shaft |
| 54 | Stopper protrusion |
| 57 | Detector |
| 58 | Shield plate |
| 60 | Feed motor |
| 62 | First gear |
| 63 | Second gear |
| 71 | Protrusion for setting |
| 72 | Protrusion for releasing |
| 73 | Joint |
| 74 | Frame reset spring |
| 75 | Stop aperture |
| 76 | Ribbon drive shaft |
| 77 | First frame holder |
| 78 | Second frame holder |
| 81 | Print head |
| 82 | Main guide shaft |
| 83 | Print head carriage |
| 84 | Timing belt |
| 85 | Carriage drive motor |
| 86 | Platen |
| 87 | Recording paper |
| 88 | Printer base |
| 90 | Ink ribbon |
| 91 | First ribbon track |
| 92 | Second ribbon track |
| 93 | Third ribbon track |
| 94 | Fourth ribbon track |
| 95 | Ribbon cassette |
| 96 | Ribbon frame |
| 100 | Start head position initialization |
| 101 | Check reference position signal |
| 102 | Move toward side II by UA |
| 103 | Move toward side III by UA |
| 104 | Check reference position signal |
| 105 | Initialize head position memory |
| 106 | $P_1$–$P_r$ movement |
| 110 | Start head position confirmation |
| 111 | Pr–Px movement |
| 112 | Check reference position signal |
| 113 | Move toward side II by UA |
| 114 | Check reference position signal |
| 120 | Interface |
| 121 | CPU |
| 122 | ROM |
| 123 | RAM |
| 124 | First I/O port |
| 125 | Second I/O port |
| 126 | Third I/O port |
| 131 | I/O port |
| 127 | PF motor driver |
| 128 | CR motor driver |
| 129 | Head driver |
| 130 | Printer unit |
| 132 | Reference position circuit |

APPENDIX A-continued

| Numbers Employed in the Figures |
|---|
| 140 Start track selection |
| 141 Initialization |
| 142 Enter standby mode operation |
| 143 Compare track numbers |
| 144 Compare with black color |
| 145 Select non-printing zone |
| 146 Set zone III position |
| 148 Color-position table |
| 154 Color-position table |
| 149 Reset to position $P_1$ |
| 155 Rest printing zone |
| 150 Update printing color |
| 151 Control data printing |
| 152 Set non-zone II position |
| 156 Track number table |

What is claimed is:

1. A method of controlling a printer having a print head that is reciprocated along a predetermined path adjacent to a recording medium in a first direction toward a first end and in a second direction toward a second end, a first space between the first and second ends defining a printing zone, a second space extending beyond the first end in the first direction defining a first non-printing zone and a third space extending beyond the second end in the second direction defining a second non-printing zone, and uses a multi-track ink ribbon having a plurality of color tracks to print images, comprising the steps of:

(a) providing a printing track setting means at the first end;

(b) moving the print head to contact the printing track setting means for positioning the ribbon in a first direction to adjust a height of said ribbon relative to said print head for placing a preselected one of the color tracks on said ink ribbon adjacent said print head for use in printing;

(c) providing a printing track releasing means; and (d) moving the print head to contact the printing track releasing means for positioning the ribbon in a second direction to release the height of the ribbon.

2. A printer for use with an ink ribbon having at least two printing tracks, comprising:

a print head that moves along a predetermined path adjacent to a recording medium;

line drive means for reciprocating said print head along said path in first and second directions;

a multi-track ink ribbon comprising a plurality of printing tracks having portions thereof disposed between said print head and recording medium, wherein said print head prints images on the recording medium with said multi-track ink ribbon; and ribbon shift means for positioning a preselected one of said tracks on said ink ribbon adjacent said print head for use in printing in response to movement of said print head, said ribbon shift means comprising:

printing track setting means for moving said ribbon in one direction to set at one desired track height from among several preselected track heights in response to movement of said print head in the first direction to a first end portion of said path for selecting the preselected track, said printing track setting means fixedly arranged at said first end portion of said path, and printing track releasing means for moving said ribbon in an opposite direction to release from the set track height in response to movement of said print head in the second direction to a second end portion of said path said printing track releasing means fixedly arranged at said second portion end, of said path.

3. The printer of claim 1, wherein said ribbon shift means comprises:

printing track selection means for moving said ribbon in one desired printing track for use by said print head in response to movement of said print head to a first end portion of said path; and printing track release means for releasing the selected printing track from use in response to movement of said print head to a second end portion of said path.

4. The printer of claim 3, wherein said first and second end portions of said path comprise first and second non-printing zones, and portions of said path other than said first and second non-printing zones comprise a printing zone.

5. The printer of claim 3 wherein:

said printing track selection means comprises ribbon height elevation means for varying a height of said multi-track ribbon relative to said print head having a driving section for being engaged and moved by physical contact with said print head and a ribbon support section for biasing said ribbon upward to a plurality of selectable heights in response to variations in movement of said print head along said path during contact;

shift setting means for engaging said ribbon height means and temporarily maintaining a selected height; and said printing track release means comprises ribbon elevation release means having a driving section for being engaged and moved by physical contact with said print head and a shift release section for raising said ribbon so as to release engagement between said ribbon height means and said ribbon.

6. The printer of claim 5 further comprising a ribbon support frame on which said multi-track ink ribbon is disposed, and wherein:

said ribbon height elevation means comprises a track setting lever having a setting drive and shift ends on opposite ends thereof, being positioned generally below and adjacent said ribbon support frame and configured to pivot said shift end under said ribbon frame by one of a plurality of predetermined distances in response to pressure exerted on said drive end by said print head contact, said shift end being generally wedge-shaped with a plurality of steps formed on an upper portion adjacent to said support frame at preselected intervals for contacting a lower surface of said ribbon frame and selectively alter a height by which said ribbon frame is supported when engaged by said shift end; and said shift setting means comprises a step stopping means disposed on said ribbon frame for engaging said steps on said shift end and substantially inhibiting further movement thereof.

7. The printer of claim 6 wherein said printing track release means comprises a release lever rotatably mounted in said printer adjacent said ribbon support frame with a release drive end for engaging said print head and an elevation end for pushing up on said ribbon frame so as to release engagement with said track setting lever.

8. The printer of claim 7, further comprising:

color memory means for storing a current color being used in printing;

color detection means for detecting requests for a new color selection input from external devices to said printer during printing operations; and track number comparison means for comparing a track number corresponding to said new color detected by said color detection means with an old track number corresponding to an old printing color stored in said color memory means.

9. The printer of claim 8 further comprising reference position detection means for detecting when said print head is located along said path in a desired reference position; and head position means for moving said print head into said first or second non-printing zones so as to selectively dis-engage and engage said track setting lever so as to select a track height and thus a track in response to said detected color and for determining an amount of movement for said print head within each nonprinting zone required to select the desired track height.

10. A method of controlling a printer having a print head that is reciprocated along a predetermined path adjacent to a recording medium between first and second ends which form boundaries of a printing zone, and uses a multi-track ink ribbon having a plurality of color tracks to print images, comprising the steps of:

actuating a ribbon height adjustment device fixedly arranged at said first end and adjacent to said ribbon when said print head enters a first non-printing zone adjacent to the first end to set a current height of said ribbon relative to said print head and place a preselected one of the color tracks on said ink ribbon adjacent said print head for use in printing;

activating a release device fixedly arranged at said second end and adjacent to said ribbon when said print head enters a second non-printing zone adjacent to the second end and releases the height set by said ribbon height adjustment device;

determining which color track is desired for printing;

moving said print head into said second non-printing zone so as to release a current color track setting and associated color track as desired; and moving said print head into said first non-printing zone by a predetermined amount so as to move said ribbon vertically to another height setting and associated color track as desired.

11. The method of claim 10, wherein said ribbon height adjustment device is configured to position said ribbon at one of a plurality of preselected heights, further comprising the steps of:

determining a relative direction and magnitude of motion required for changing the height of said ribbon to obtain a new desired color;

moving said print head into said second non-printing zone when the direction of ribbon movement is to a lower ribbon vertical height; and moving said print head into said first non-printing zone when the direction of ribbon movement is to a higher ribbon vertical height.

12. The method of claim 11 wherein the amount of movement of said print head in each selected non-printing zone is substantially limited to that amount needed to just effect a desired height change.

13. The method of claim 10 further comprising the steps of:

storing a new printing color selection in a color memory;

comparing a track number corresponding to the new color with an old track number corresponding to a currently in use color, as previously stored in said color memory;

releasing a currently selected track and placing said ribbon at a lower height relative to said print head when the new track number is larger than said old track number;

setting a new higher vertical ribbon height relative to said print head when the new track number is smaller than said old track number; and otherwise operating at the current vertical ribbon height when said new and old track numbers are the same.

14. The method of claim 13 wherein said ribbon is mounted on a ribbon support frame and said step of releasing comprises lifting said ribbon frame vertically to release a current vertical height setting.

15. The method of claim 13 wherein said ribbon is mounted on a ribbon support frame and said step of setting comprises interfacing one of a plurality of vertical height stops with said frame so as to prohibit further vertical displacement and temporarily secure said frame in a preselected substantially fixed vertical position.

16. The method of claim 10 further comprising the steps of:

detecting a reference position for said print head along said print path relative to said first and second ends;

initializing a starting home position for said print head in relation to said reference position; and moving said print head to said reference position after performing at least a ribbon track release activation step.

17. The method of claim 16 further comprising the steps of:

confirming a current position of said print head in response to movement with respect to said reference position; and moving said print head toward said reference position following said confirmation step when an error in the position of said print head has occurred and said print head is not yet in said reference position.

* * * * *